US009719327B2

(12) United States Patent
Gano

(10) Patent No.: US 9,719,327 B2
(45) Date of Patent: Aug. 1, 2017

(54) MAGNETIC KEY FOR OPERATING A MULTI-POSITION DOWNHOLE TOOL

(71) Applicant: HALLIBURTON ENERGY SERVICES, INC., Houston, TX (US)

(72) Inventor: John C. Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 655 days.

(21) Appl. No.: 14/173,816

(22) Filed: Feb. 6, 2014

(65) Prior Publication Data

US 2014/0151019 A1 Jun. 5, 2014

Related U.S. Application Data

(62) Division of application No. 13/988,301, filed as application No. PCT/US2012/052731 on Aug. 28, 2012, now Pat. No. 8,720,540.

(51) Int. Cl.
*E21B 34/14* (2006.01)
*E21B 23/00* (2006.01)
(Continued)

(52) U.S. Cl.
CPC ..... *E21B 34/14* (2013.01); *E21B 23/00* (2013.01); *E21B 23/01* (2013.01); *E21B 23/02* (2013.01); *E21B 23/08* (2013.01); *E21B 34/066* (2013.01)

(58) Field of Classification Search
CPC .... E21B 23/00; E21B 23/08; E21B 2034/007; E21B 34/066; E21B 34/14
See application file for complete search history.

(56) References Cited

U.S. PATENT DOCUMENTS 4,991,564 A 2/1991 Takahashi et al.
5,299,640 A 4/1994 Streich et al.
(Continued)

FOREIGN PATENT DOCUMENTS

WO 0055532 A1 9/2000
WO 2014035381 A1 3/2014

OTHER PUBLICATIONS

Foreign Communication from a Related Counterpart Application, International Search Report and Written Opinion dated Mar. 19, 2013, International Application Serial No. PCT/US12/52731, filed on Aug. 28, 2012.
(Continued)

*Primary Examiner* — David Andrews
*Assistant Examiner* — Tara Schimpf
(74) *Attorney, Agent, or Firm* — Scott Richardson; Baker Botts L.L.P.

(57) ABSTRACT

A downhole tool for use in a wellbore tubular string comprises a housing having a bore therethrough forming part of a fluid flowpath through the wellbore tubular string, a sliding member operable to slide with respect to the housing, a plurality of magnetic pins, and a corresponding plurality of springs. A sliding line is formed by interfacing surfaces of the sliding member and the housing, and the plurality of pins comprise a locked position and an unlocked position whereby in the locked position at least one pin spans the sliding line to prevent the sliding member from sliding with respect to the housing and in the unlocked position no pins span the sliding line. The plurality of springs biases the pins towards the locked position.

19 Claims, 15 Drawing Sheets

(51) Int. Cl.

| | |
|---|---|
| ***E21B 23/08*** | (2006.01) |
| ***E21B 34/06*** | (2006.01) |
| ***E21B 23/02*** | (2006.01) |
| ***E21B 23/01*** | (2006.01) |

(56) References Cited

U.S. PATENT DOCUMENTS

| | | | | |
|---|---|---|---|---|
| 5,309,988 | A | 5/1994 | Shy et al. | |
| 6,032,734 | A * | 3/2000 | Telfer | E21B 23/00 166/106 |
| 2007/0272411 | A1 | 11/2007 | Lopez de Cardenas et al. | |
| 2010/0282475 | A1 | 11/2010 | Darnell et al. | |
| 2011/0147007 | A1 | 6/2011 | O'Malley et al. | |
| 2011/0284240 | A1 * | 11/2011 | Chen et al. | E21B 23/00 166/373 |
| 2012/0152550 | A1 | 6/2012 | East, Jr. | |
| 2013/0020092 | A1 * | 1/2013 | Ramon et al. | E21B 23/01 166/381 |
| 2013/0048290 | A1 * | 2/2013 | Howell et al. | E21B 34/08 166/305.1 |
| 2014/0060803 | A1 | 3/2014 | Gano | |

OTHER PUBLICATIONS

FAIPP Pre-Communication dated Nov. 8, 2013, filed May 17, 2013, U.S. Appl. No. 13/988,301.
FAIPP Office Action dated Jan. 10, 2014, filed May 17, 2013, U.S. Appl. No. 13/988,301.
Notice of Allowance dated Feb. 20, 2014, filed May 17, 2013, U.S. Appl. No. 13/988,301.

* cited by examiner

MAGNETIC KEY FOR OPERATING A MULTI-POSITION DOWNHOLE TOOL

CROSS-REFERENCE TO RELATED APPLICATIONS

This application is a divisional of and claims priority under 35 U.S.C. 121 to U.S. patent application Ser. No. 13/988,301, filed May 17, 2013, entitled, "Magnetic Key for Operating a Multi-Position Downhole Tool," by John C. Gano, which is a filing under 35 U.S.C. 371 as the National Stage of International Application No. PCT/US2012/052731, filed Aug. 28, 2012, entitled "Magnetic Key for Operating a Multi-Position Downhole Tool," both of which are incorporated herein by reference in their entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon wells (for production of hydrocarbons such as oil and gas) typically have a wellbore drilled into a formation in the ground containing the hydrocarbons. Such formations typically have one or more production zones that may be accessed to extract the formation fluids (for example, hydrocarbons) into the wellbore. This is typically accomplished in the producing section as an open hole or uncased completion but it can also be completed by placing a casing along the wellbore and perforating the casing in a position adjacent to a production zone. Often these production zones may be separated/isolated from each other using packers inserted into the wellbore. Fluid in the production zone is then drawn into a completion string (typically comprising tubing for pumping in to and out of the well and one or more downhole tools) in the wellbore that runs to the surface. One or more of the downhole tools in the completion string may have multiple positions. For example, if the downhole tool is a flow control device having a valve, the downhole tool might have an open position and a closed position. Other examples of a downhole tool might include a packer, safety valve, sliding sleeve, adjustable choke, pump, and/or perforating apparatus. During production of the well, it may be desirable to modify the function and/or position of such a downhole tool for example, moving a valve from a closed position to an open position or vice versa). It may, however, be quite challenging to interact with downhole tools in a completion string that is downhole in a well.

SUMMARY

Aspects of the disclosure may include embodiments of a downhole tool for use in a completion string. The downhole tool comprises a housing having a bore therethrough forming part of a fluid flowpath through the completion string, a sliding member operable to slide with respect to the housing, a magnetic reader operable to detect magnetic patterns from the bore of the downhole tool, and an actuator. The sliding member comprises a locked position and an unlocked position, and the actuator is operable to move the sliding member from a locked (or closed) position to an unlocked position.

Additional aspects of the disclosure may include embodiments of a downhole tool for use in a completion string. The downhole tool comprises a housing having a bore therethrough forming part of a fluid flowpath through the completion string, a sliding member operable to slide with respect to the housing, a plurality of magnetic pins, and a corresponding plurality of springs. A sliding line is formed by interfacing surfaces of the sliding member and the housing, and the plurality of pins comprise a locked position and an unlocked position whereby in the locked position at least one pin spans the sliding line to prevent the sliding member from sliding with respect to the housing and in the unlocked position no pins span the sliding line. The plurality of springs or weak magnetic attraction bias the pins towards the locked position.

Other aspects of the disclosure may include embodiments of a key for use in a downhole completion string having at least one downhole tool. The key comprises a body operable to fit in a bore of the completion string, and a plurality of magnets, each having at least one pole directed radially outward. The plurality of magnets are located and oriented with respect to the body to form a magnetic pattern. These magnetic fields can be generated electromagnetically if desired. The electromagnetic key can be powered from the downhole tractor that is delivering the key to location. The tractor can be autonomous, wireline, or other deployment means.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
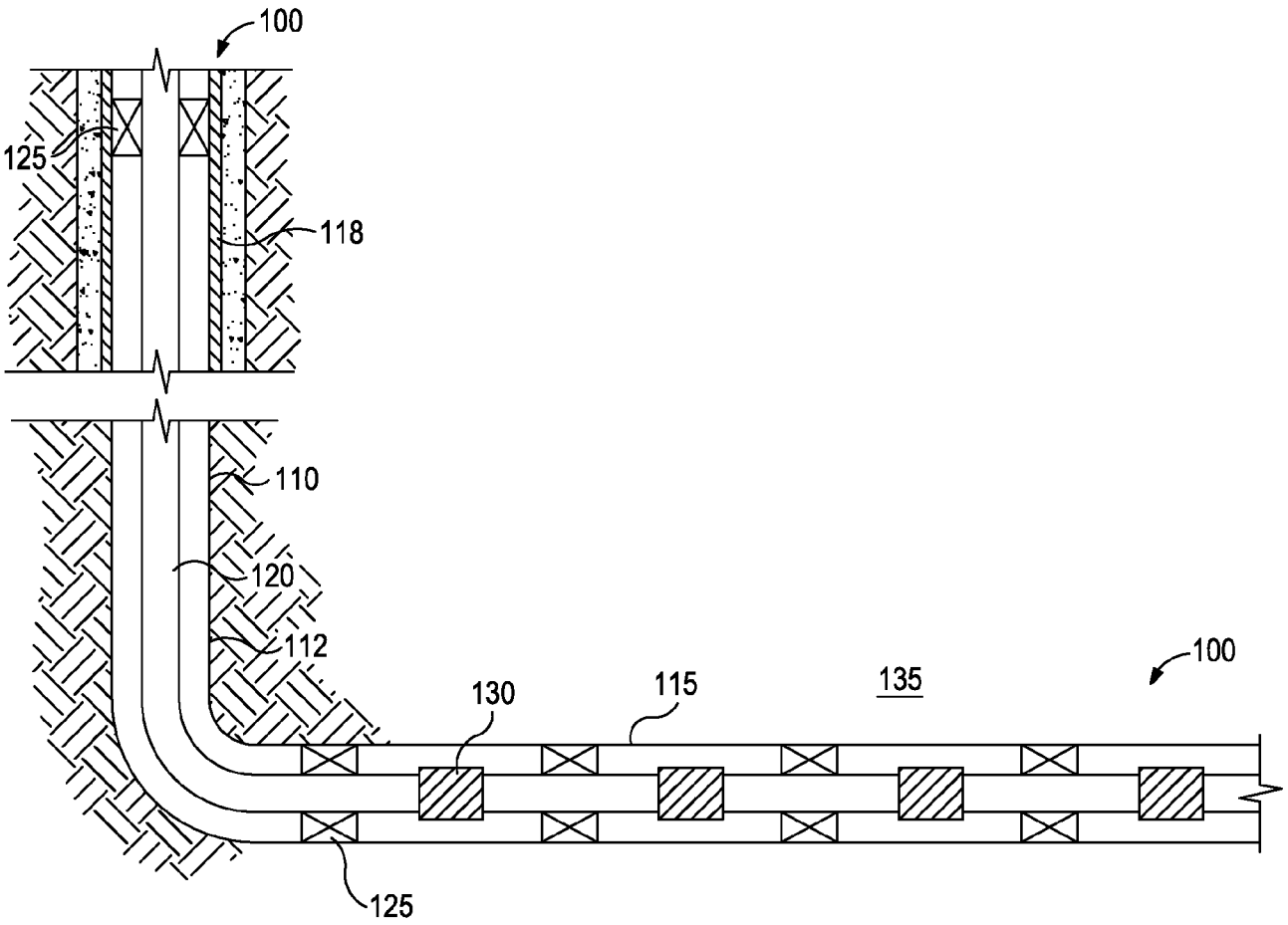
FIG. 1 is a schematic illustration of a well system including a plurality of downhole tools according to an embodiment.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

The following brief definition of terms shall apply throughout the application:

The term "downhole tool" includes any tool that might be used in a drilling, completion, production, and/or workover string (e.g., a wellbore tubular string) in a wellbore; typically the tool might be a multi-position tool having a movable component (which in some embodiments might provide control over some aspect of the completion string and the fluid therein) for example the downhole tool might comprise an inflow control device having a valve with two or more positions (such as an open and a closed position);

The term "magnetic pattern" includes the location, orientation, spacing, coding, polarity, and/or number of magnets within a key or tool;

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Unless otherwise specified, any use of any form of the terms "connect," "engage," "couple," "attach," or any other term describing an interaction between elements is not meant to limit the interaction to direct interaction between the elements and may also include indirect interaction between the elements described.

Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal," "longitudinally," "axial," or "axially" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

Embodiments relate generally to devices, as well as methods for using such devices, for controlling elements and/or aspects of a completion string in a downhole well. In considering ways to control and/or adjust different aspects of a completion string, it may be noted that the ability to remotely control (for example, modify the position/function of) a downhole tool (e.g. a flow control device) in a wellbore may be desired during production of the well. For example, there may be a need to bypass the flow controls to stimulate the formation (production zone) or remove filter cake. There may also be a need to isolate production zones or individual flow control devices (for maintenance purposes, for example) and/or conduct multiple (and possibly different) operations on separate zones of the wellbore during the production life of a well. Therefore, systems, devices, and methods have been developed for remotely controlling the position of such a multi-position downhole tool in a completion string during production of a well, which may allow the one or more multiple position downhole tools to be individually or collectively exercised or operated, providing for more flexible control of downhole tools in a wellbore and, therefore, more control of overall production. More specifically, system(s), device(s), and method(s) have been developed for unlocking (or locking) a multi-position tool to allow for movement from one position to another.

In order to selectively actuate one or more of the downhole tools, a magnetic lock and key arrangement may be used. The magnetic lock may have magnets or ferromagnetic pins that function similar to tumblers in a keyed lock, and the key may have magnets capable of actuating the tumblers through the interaction of the magnetic fields. When the magnetic key is matched to the magnetic lock, the downhole tool may be unlocked and actuated. For example, various embodiments may generally comprise a multi-position sliding member and a fixed housing, where the sliding member may be held in a position with respect to the fixed housing by tumbler pins. These tumbler pins may have shaped surfaces, coatings, and/or be formed of various materials to minimize the effects of friction and reduce the activation force. Other embodiments may comprise a key (which may comprise a magnetic pattern), where interaction with the key (and/or the magnetic pattern therein) may cause the tumbler pins to move to an unlocked position, which may allow for movement of the multi-position sliding member from a first position to a second position with respect to the fixed housing. In other embodiments, the key may comprise a magnetic pattern on a magnetic strip (e.g., similar to a magstripe and/or swipe card magnetic strip), a pattern of magneto, and/or the like. A reader may be positioned to interact with the magnetic pattern and actuate an unlocking mechanism. In some embodiments, the reader may send a signal to a separate unlock actuation mechanism and/or process to actuate the downhole tool. Such a system may comprise electronic components (e.g., electronic readers) and hydraulic and/or mechanical components to effect the actuation of the downhole tool.

In an embodiment, the sliding member and fixed housing may be components of a multi-position downhole tool for use in a completion string of a wellbore. The magnetic key and lock arrangement may be used to selectively unlock one or more downhole tools. For example, a single key may unlock multiple downhole tools, or a plurality of keys may be used to unlock one or more downhole tools. When a plurality of keys is used, it may be separately introduced into the wellbore or introduced as a single component. Using the various possible combinations, any number of downhole tools can be actuated using a key that may be pumped down a wellbore tubular. While described as being pumped down a wellbore, the key may also be driven (e.g., using an electrical or mechanical force such as a tractor) down the wellbore. In an embodiment, a tractor may be autonomous (e.g., containing a self-contained power source), coupled to a wireline, and/or utilize other deployment means or devices. When the key is coupled to a power source such as a wireline, the electromagnetic key may itself be powered from the power source.

Referring initially to FIG. 1, an exemplary well system is depicted, comprising a wellbore 100 with both a substantially vertical section 110 and a substantially horizontal section 115, casing 118, a tubular string 120, a plurality of spaced apart packers 125 and downhole tools 130 (which may include flow control devices, for example) and a formation 135. In the example shown in FIG. 1, production of hydrocarbons may be accomplished by flowing fluid containing hydrocarbons from the formation 135, though the uncased and open horizontal wellbore section 115 and into the tubular string 120 through the plurality of downhole tools 130 (although in other embodiments, production might include flowing hydrocarbon containing fluid from the formation through perforations in the casing and into the tubular string 120 through downhole tool(s) 130). As an example, downhole tools 130 might comprise an inflow control device (ICD) that provides for the filtering of unwanted material from the formation 135 and/or for the metering of fluid input from the formation 135 into the tubular string 120. Packers 125 isolate each individual downhole tool 130 into different zones or intervals along the wellbore 100 by providing a seal between the casing/wellbore wall 112 and the tubular string 120.

Although FIG. 1 depicts the downhole tools 130 in an open and uncased horizontal wellbore section 115, it is to be understood that downhole tools may also be used in cased wellbores. Further, although FIG. 1 depicts single downhole tools 130 as being isolated by the packers 125, it is to be understood that any number of downhole tools may be grouped together and isolated by the packers, without departing from the principles of the present disclosure. In addition, even though FIG. 1 depicts the downhole tools 130 in a horizontal wellbore section 115, it is also to be understood that the downhole tools 130 are equally suited for use in wellbores having other directional configurations including vertical wellbores, deviated wellbores, slanted wellbores, multilateral wellbores and the like.

In embodiments, a downhole tool may be incorporated into the completion string of the wellbore, with the downhole tool comprising a sliding member and a fixed housing. The fixed housing may comprise a bore therethrough forming part of a fluid flowpath through the completion string, and the sliding member may be operable to slide with respect to the fixed housing (from an initial position to at least another position, thereby providing multi-positional functionality for the downhole tool). In some embodiments, the sliding member may be operable to slide axially/longitudinally with respect to the housing, while in other embodiments the sliding member may be operable to slide rotationally/circumferentially with respect to the fixed housing. The sliding member typically may comprise locked and unlocked positions, with an unlocked position allowing for movement of the sliding member with respect to the fixed housing and a locked position that may not allow for (i.e. prevent) movement of the sliding member with respect to the fixed housing. The sliding member can be a concentric sleeve or other configuration such as a pencil piston in the housing wall. The sliding member may be actuated from one position to another position (for example, from a locked position to an unlocked position, or vice versa) using a magnetic key located within the bore of the downhole tool. In other words, the magnetic key may interact magnetically with the downhole tool (if they have corresponding magnetic patterns) to lock and/or unlock the sliding member. Moving the sliding member to an unlocked position may also comprise applying a force to the sliding member to induce sliding, wherein the impetus for sliding motion of the sliding member may not be provided by the key, the magnetism of the key, or direct influence of a magnetic pattern within the key. Examples of such force means may include a hydraulic force using one or more of the following: a pressure differential between the formation and the bore of the completion string, a pressure differential across the key, and/or communication with a stored pressure reservoir within the wellbore. In other embodiments, the force means may comprise a mechanical force such as one or more of the following: a stored spring force, gravity (in a vertical wellbore), and/or physical interaction of the magnets in the key. The force may come from the key in the form of a mechanical detent or other mechanical connection to the key or key deployment system. In other embodiments, the force means may comprise an electrical force, which may be electromechanical and/or electrohydraulic and may utilize one or more of the following: batteries to run a motor (such as in a pump), lines from the surface of the wellbore to run a motor (such as in a pump), and/or inductive coupling to power a gear (such as in a pump). The magnetic key typically may have a magnetic pattern designed to interact with corresponding downhole tool(s).

Figure 2A:
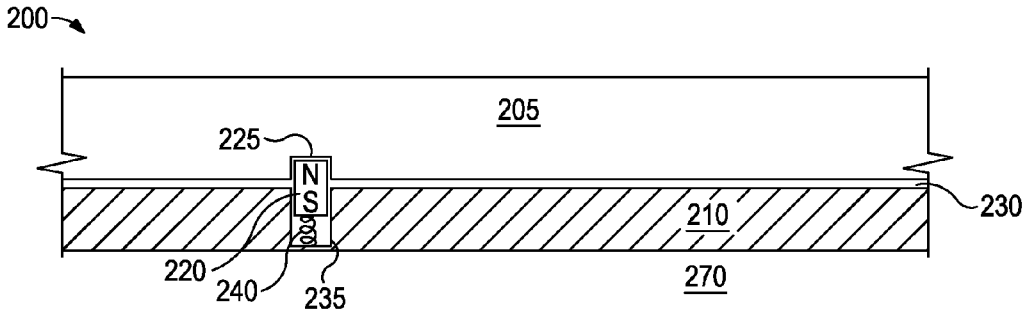
FIGS. 2A-2B illustrate embodiments of a downhole tool with a locking mechanism.
Figure 2B:
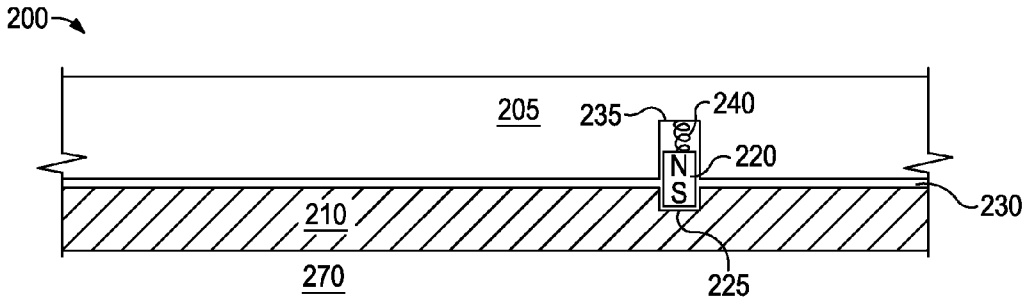

In embodiments shown in FIGS. 2A-2B, the sliding member 205 of a downhole tool 200 may be held in a position with respect to the fixed housing 210 with one or more tumbler pins 220, which may be oriented radially, circumferentially and/or longitudinally (where in the embodiment of FIGS. 2A-2B, the pins may be oriented radially) and may be housed in corresponding holes 235 in the fixed housing 210 (as shown in FIG. 2A), the sliding member 205 (as shown in FIG. 2B), or a combination of both. In an embodiment, the tumbler pins 220 may interact mechanically with notches 225 in the surface of the sliding member 205 (as shown in FIG. 2A) and/or the surface of the fixed housing 210 (as shown in FIG. 2B), with the notches 225 operable to receive a portion of the tumbler pins 220, possibly in a radial direction, axial, circumferentially, or other direction. Typically, the tumbler pins 220 may be comprised of magnetic material that would create magnetic poles (north and south) within the tumbler pins. The tumbler pins however can be nonmagnetic material that is positioned by a magnetic field generated by a magnetic material. For example, the tumbler can be ferromagnetic and respond to magnetic field spacing rather than to a particular pole. Magnetic materials may include iron, cobalt, rare-earth metal alloys, ceramic magnets, alnico nickel-iron alloys and/or rare-earth magnets such as a Neodymium magnet and a Samarium-cobalt magnet, or other known materials such as Co-netic AA®, Mumetal®, Hipernon®, Hy-Mu-80®, Permalloy® which all may comprise about 80% nickel, 15% iron, with the balance being copper, molybdenum, or chromium. The tumbler pins 220 may be considered in a locked position when at least one pin 220 crosses or spans a sliding line 230 (thereby creating mechanical interference preventing movement of the sliding member with respect to the housing); the tumbler pins 220 may be considered in an unlocked position when no tumbler pin 220 crosses or spans the sliding line 230. In the embodiment of FIGS. 2A-2B the sliding line 230 may be located between the sliding member 205 and the fixed housing 210, but in other embodiments, the sliding line may be any line that a tumbler pin may cross or span when the pin is in a locked position. The tumbler pins 220 may interact with one or more biasing members 240 (such as a spring, for example) operable in the embodiments of FIGS. 2A and 2B to bias the tumbler pins 220 towards a locked position. Alternatively, in other embodiments the biasing member 240 might bias the tumbler pin towards an unlocked position. If more than one tumbler pin is housed in the downhole tool 200, the location of the tumbler pins and corresponding notches may be longitudinal along the length of the bore of the downhole tool 270 and/or circumferential around the bore of the downhole tool 270, and such a plurality of magnetic tumbler pins may be located and/or magnetically oriented to form a magnetic pattern within the downhole tool. The magnetic pattern created by the tumbler pins may be operable to interact magnetically with a corresponding magnetic pattern in a key located in the bore of the downhole tool, for example, thereby allowing a magnetic key to lock and/or unlock the sliding member 205 of the downhole tool. While these and other embodiments discussed herein might typically discuss the use of an unlocking magnetic pattern in a key to unlock the sliding member, persons of ordinary skill will understand that in other configurations and embodiments (for example with a housing member biasing the tumbler pins towards an unlocked position) the key could have a locking magnetic pattern that locks the sliding member in place. Typically the sliding member 205 and fixed housing 210 of the downhole tool 200 may optionally comprise a non-ferrous material, so as to not interact with the magnetic pins 220 or a magnetic pattern in a key. Non-ferrous material may include copper, aluminum, composite material, titanium, stainless steel, PEEK®, Teflon®, carbon-carbon composite, phenolic, fiber glass, and/or electroless nickel or cadmium.

Figure 3A:
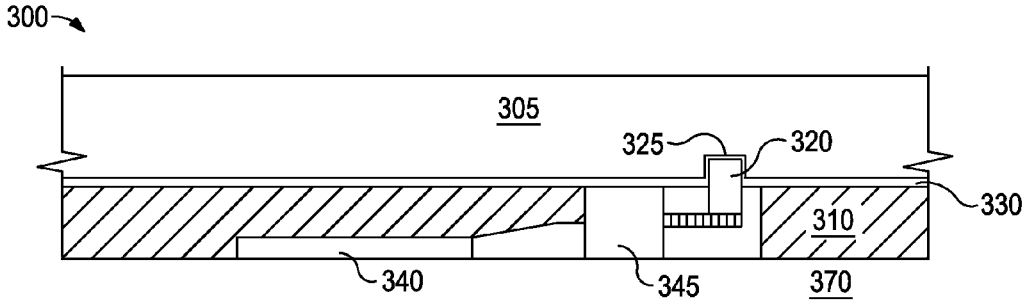
FIGS. 3A-3B illustrate other embodiments of a downhole tool with a locking mechanism.
Figure 3B:
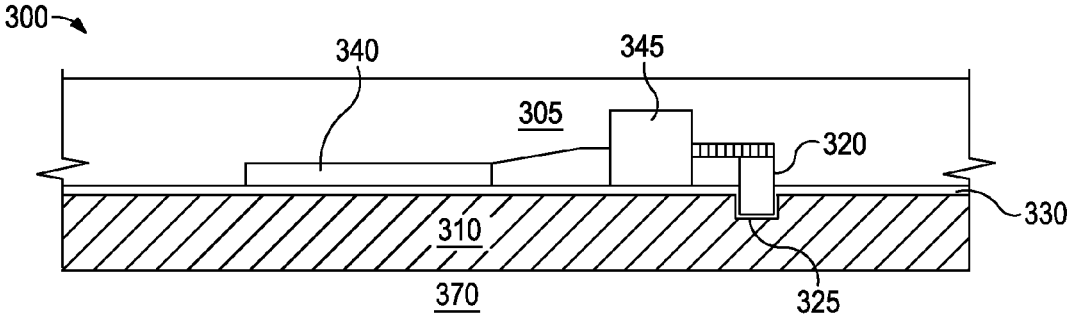

In other embodiments shown in FIGS. 3A-3B, the sliding member 305 of a downhole tool 300 may be held in a locked or unlocked position by an electronic actuator 345. The downhole tool 300 may comprise a magnetic reader 340 operable to detect magnetic patterns located in the bore 370 of the downhole tool 300, where the unlocking (or locking) magnetic pattern may be housed in a movable key. The electronic actuator 345 may lock or unlock the sliding member 305 in response to detection of a magnetic pattern (typically from a magnetic key in the bore of the downhole tool) by the magnetic reader 340. In an embodiment, unlocking the sliding member 305 may comprise moving one or more pins 320 so that none of the one or more pins 320 span a sliding line 330 (which, in the embodiment of FIGS. 3A-3B may be located between the sliding member 305 and the fixed housing 310). In the embodiment of FIG. 3A, the magnetic reader 340, electronic actuator 345 and pin(s) 320 may be housed in the fixed housing 310, with the pin(s) 320 interacting with a corresponding notch 325 in the sliding member 305. In the embodiment of FIG. 3B, the magnetic reader 340, electronic actuator 345 and pin 320 may be housed in the sliding member 305, with the pin(s) 320 interacting with a corresponding notch 325 in the fixed housing 310. In alternative embodiments, the electronic actuator 345 might directly move the sliding member between sliding positions, thereby combining the locking/unlocking and the sliding force in a single unit.

Figure 4:
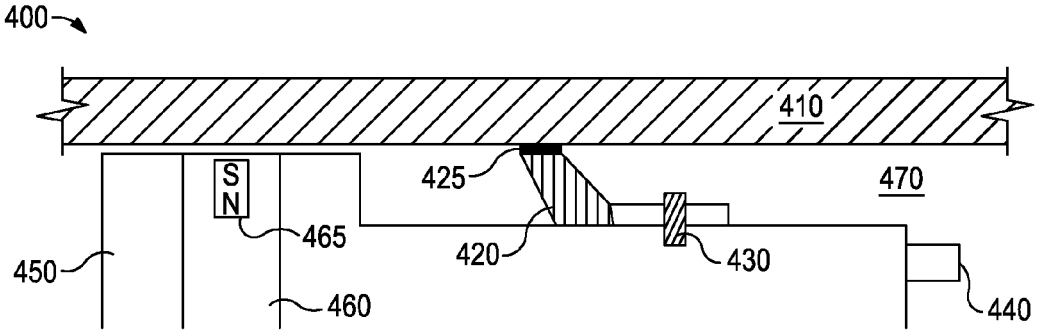
FIG. 4 illustrates an embodiment of a magnetic pattern key which may be used to interact with a corresponding downhole tool.

FIG. 4 shows an embodiment of a device comprising a magnetic pattern key operable to interact magnetically with a (magnetic pattern activated) downhole tool in a way that may affect an unlocking mechanism within the downhole tool. As shown in the embodiment of FIG. 4, the key 460 may be located within a dart 400 and/or have a housing or body similar to a dart, which may comprise a body 450 operable to fit within the bore 470 of the completion string and may be driven downhole to one or more positions within the completion string that may allow for interaction between the key and one or more downhole tools. The key 460 may contain a magnetic pattern by comprising one or more magnets 465 that may be located (longitudinally and/or circumferentially) and oriented (with a specific polarity) to magnetically interface with a corresponding unlocking mechanism in a downhole tool in the completion string. In some embodiments, the dart 400 may comprise an optional seal 420 (located circumferentially about the body 450) operable to seal with the inner surface 425 of the completion string bore 410 and seal the bore 470 of the completion string when the body 450 is in place in the completion string (so that, for example, fluid pressure in the bore may provide longitudinal movement of the dart within the completion string). The seal 420 may additionally comprise an optional shearing pin 430 operable to shear upon application of a shearing force, thereby allowing fluid flow around the body when the key is in place in the bore of the completion string. Typically, such a shearing force might only be applied in proximity to the bottom of the well. In some embodiments, the dart 400 may optionally comprise an activator 440 located on the (front or forward) nose of the body 450 and operable to configure the plurality of magnets 465 into a second magnetic pattern, which might for example be operable to magnetically interface with an unlocking mechanism in a corresponding downhole tool. In an embodiment, the activator 440 may be activated by contact with the bottom of a wellbore or other suitable feature within the bore 470. The body of the key, as well as the spacing between the magnets in a magnetic pattern, may optionally comprise non-ferrous material so as not to interfere with the magnetic interaction between the magnetic pattern of the key and the magnetic component of the downhole tool.

Embodiments of a key may magnetically interact with corresponding embodiments of one or more downhole tools. In embodiments, for example, the unlocking mechanism of a downhole tool comprises tumbler pins that may interact with the magnetic pattern in a key using attraction, repulsion or a combination of both. Magnetic interaction may comprise repositioning the tumbler pins radially to cross or span a sliding line into locked/unlocked positions. The presence of the magnetic pattern of a key may create an attractive and/or repulsive force that may cause the tumbler pins to act against the corresponding biasing members and withdraw across the sliding line between the sliding member and the fixed housing. When the tumbler pins no longer span the sliding line (i.e. no pin spans the sliding line), they may be considered in an unlocked position, and the sliding member may then be free to slide (for example, in an axial direction).

In other embodiments in which the unlocking mechanism of a downhole tool may comprise a magnetic reader and electronic actuator, the electronic actuator may unlock the sliding member in response to detection of an unlocking magnetic pattern (which may be located within a key) by the magnetic reader. In an embodiment, unlocking the sliding member may comprise moving one or more radial pins so that none of the one or more pins span the sliding line between the sliding member and the fixed housing. Alternatively, the electronic actuator could physically move/reposition the sliding member from a closed position to an open position, or vice versa.

To adjust a downhole tool within a completion string, a key typically might be positioned adjacent to a desired downhole tool. This may be accomplished by incorporating the key into a dart that might be driven downhole in the completion string. The means for positioning the dart, and therefore the key, may involve hydraulically pumping the dart downhole. In one embodiment, the dart might for example be pumped down to a position adjacent to a downhole tool and then allowed to interact with the downhole tool, possibly causing a sliding member within the tool to slide axially. In some embodiments, the key may be driven downhole using an electrical and/or mechanical force other than pumping pressure (e.g., using a tractor to convey the key within the wellbore). In an embodiment, the dart may comprise a seal (located circumferentially about the body) operable to seal with the surface of a fixed housing and seal the bore of the completion string when the body is in place in the completion string (so that fluid pressure in the bore may provide longitudinal movement of the dart in the completion string). The seal may additionally comprise a shearing pin operable to shear upon application of a shearing force, thereby allowing fluid flow around the body when the key is in place in the bore of the completion string. Then the dart might be pumped and/or driven down past a shearing element in the bore (designed to interact mechanically with the seal and the driving force to shear the shear pin) and then to the bottom of the wellbore (where it may stay at the bottom in some embodiments). In this approach, the key would magnetically interact with the downhole tool(s) at issue on the way downhole. If using this method, multiple darts could be sent down into the wellbore where they would stack, or queue-up, at the bottom.

Another method embodiment might involve pumping and/or driving the dart to the bottom of the well without effective (operational) interaction with any (or some of the) downhole tools on the way to the bottom. Then, when the dart hits the bottom of the well, an activator, such as a button, might activate the magnetic pattern key in the dart, for example, by positioning and/or orienting the magnets within the key to the correct locations for interaction with one or more of the downhole tools. The key might then interact with one or more corresponding downhole tools (having corresponding magnetic patterns) as the dart travels back up the bore in the completion string and the dart might be recovered at the surface of the wellbore. Other means for positioning the dart might include using a wire line, a slickline, coil tubing, and/or jointed pipe, for example, and persons of ordinary skill will understand these and other such positioning means. Persons of ordinary skill will also understand that the key might have a first magnetic pattern for interaction with one or more corresponding downhole tools on the way downhole, and then might be reconfigured to have a second magnetic pattern for interaction with other downhole tools having different magnetic patterns on the way up.

In an embodiment, the magnetic pattern within the key may be designed to interact with one or more downhole tools and/or to not interact with other downhole tools. This may be accomplished by arranging the magnetic pattern in a key to interact with an unlocking mechanism in the downhole tool(s) where a change is desired and to not interact with an unlocking mechanism in the downhole tool(s) where no change is desired. In one embodiment, this may require that the different downhole tools located in a completion string have differences in the location and polarity of the tumbler pins located therein. In other words, different downhole tools might have different magnetic patterns. In another embodiment, this may require that magnetic readers located within the different downhole tools be activated by different magnetic patterns within a key. Interaction may be affected by the location of the magnets in the magnetic pattern of the key, spacing between the magnets, and/or the orientation of the magnets (i.e. the polarity of the magnets). In yet another embodiment, a key may comprise more than one magnetic pattern in order to allow for interaction with more than one downhole tool having one or more different corresponding unlocking magnetic patterns.

Figure 5A:
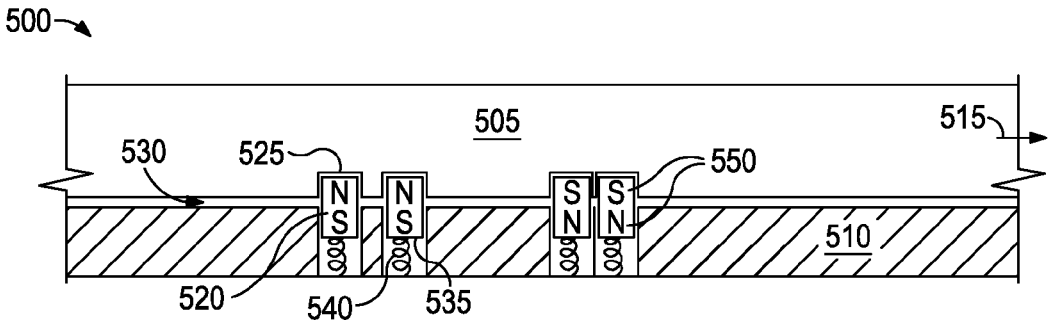
FIGS. 5A-5D illustrate an embodiment of a method for using a key to interface with a downhole tool.

The embodiment of FIGS. 5A-5D shows an exemplary method of locking and/or unlocking a sliding member 505, and the movement of the sliding member 505 with respect to a fixed housing 510. In the embodiment shown in FIG. 5A, a downhole tool 500 may comprise a sliding member 505 (which may slide in an axial/longitudinal direction 515) and a fixed housing 510. The sliding member 505 may be held in a locked position by one or more tumbler pins 520 that may interact between the sliding member 505 and the fixed housing 510 (for example, locking the sliding member in place with respect to the housing by spanning the sliding line, or allowing sliding when the pins are in an unlocked position, with no pins spanning the sliding line). In the exemplary embodiment shown in FIG. 5A, four tumbler pins 520 may be used to lock the sliding member 505, (although persons of ordinary skill will appreciate that embodiments might use any number of tumbler pins, typically a plurality to allow for a magnetic pattern). In an embodiment, the tumbler pins 520 may be spaced longitudinally along the length of the downhole tool 500 (although other embodiments might have alternate spacing arrangements) and may be considered in a locked position when at least one tumbler pin 520 crosses or spans a sliding line 530 between the fixed housing 510 and the sliding member 505. In the embodiment of FIG. 5A, the tumbler pins 520 may be housed within holes 535 in the fixed housing 510 of the downhole tool 500, and may interact with notches (or holes) 525 in the surface of the sliding member 505 that may receive (one end of) the tumbler pins 520 in a radial direction. The tumbler pins 520 may be held in place in the notches 525 of the sliding member 505 with a biasing member 540 (such as a spring) that may serve to bias the tumbler pins 520 towards a locked position. In an embodiment, the tumbler pins 520 may comprise magnetic material that would create magnetic poles 550 (north and south) within the tumbler pins 520. Thus, FIG. 5A shows a downhole tool with its sliding member (and/or its tumbler pins) in a locked position.

Figure 5B:
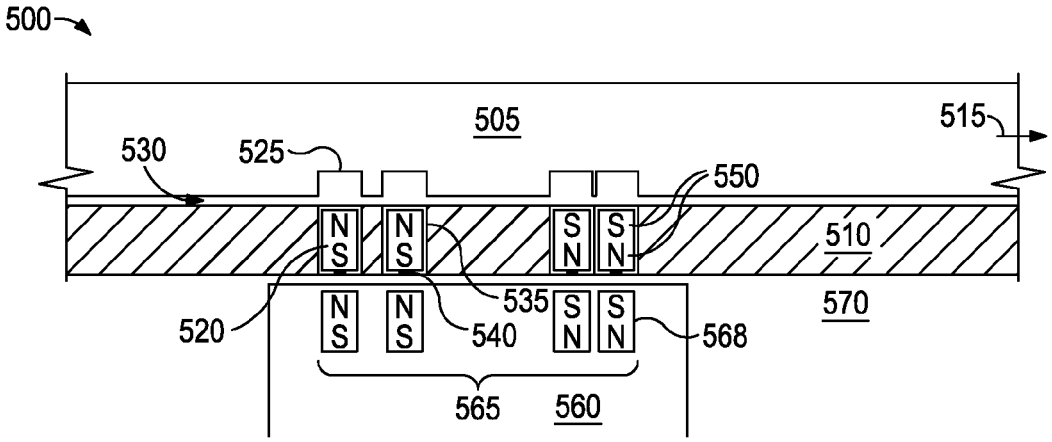

In the embodiment of FIG. 5B, a key 560 may be introduced into the completion string to interact with the downhole tool 500. The key 560 may fit within the bore 570 of the completion string and may be driven downhole to a position within the completion string that may allow for interaction with one or more downhole tools 500 (typically within the bore of such one or more downhole tools). The key 560 may contain a magnetic pattern 565 comprising one or more magnets 568 that may be located (radially/circumferentially and/or axially/longitudinally) and oriented (with a specific polarity) to magnetically interact with corresponding tumbler pins 520 in the downhole tool 500. In other words, the magnetic pattern of the key 560 may correspond to a related magnetic pattern of the tumbler pins in a downhole tool with which the key is designed to magnetically interact. Magnetic interaction may comprise repositioning the tumbler pins 520 radially to cross the sliding line 530 into locked/unlocked positions. In the embodiment of FIG. 5B, the presence of the magnetic pattern 565 may create an attractive force between the magnets 568 and the tumbler pins 520 that may cause the tumbler pins 520 to act against the biasing members 540 and withdraw across the sliding line 530 between the sliding member 505 and the fixed housing 510 so that the pins 520 do not span the sliding line, but are instead entirely contained within the holes in the housing). The magnets 568 in the key 560 may be oriented in such a way that they attract all of the tumbler pins 520 located within the fixed housing 510 and the tumbler pins 520 may move radially toward the key 560 and cross the sliding line 530 into an unlocked position (as shown in FIG. 5B). Thus, FIG. 5B shows a key interacting magnetically with a corresponding downhole tool (in which the magnetic pattern of the key corresponds to a related magnetic pattern of the tumbler pins within the downhole tool) to unlock the sliding member (by for example retracting the pins so that they do not span the sliding line).

Figure 5C:
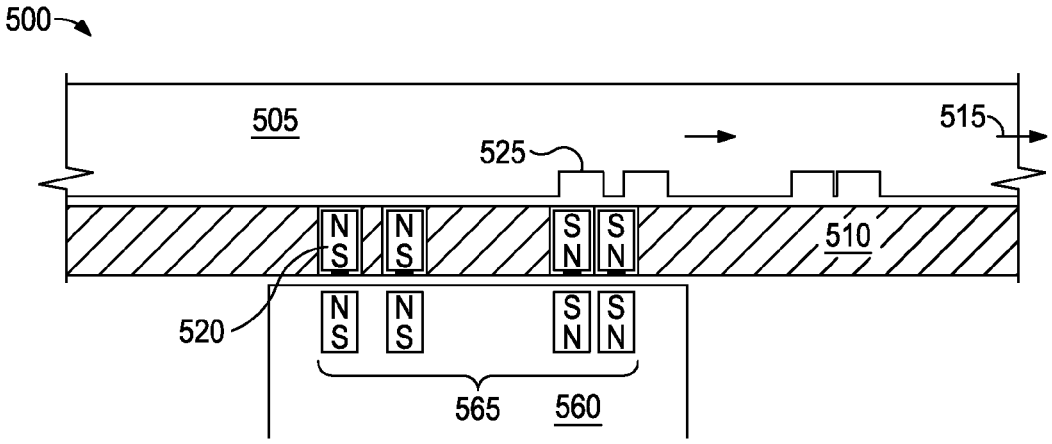
Figure 5D:
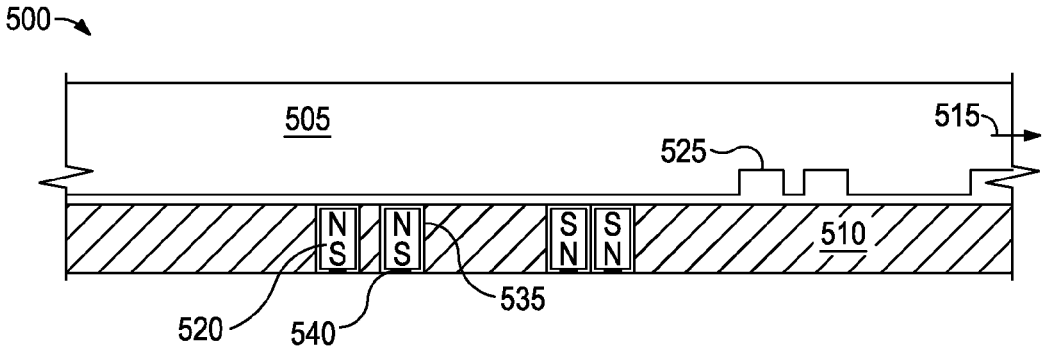

In the embodiment shown in FIG. 5C, the key 560 may remain in interaction with the tumbler pins 520 within the fixed housing 510 and allow the sliding member 505 to slide in an axial direction 515. The interaction between the tumbler pins 520 and the magnetic pattern 565 of the key 560 may continue because of the attractive force between the magnets 568 and the pins 520. The tumbler pins may be kept from entering one of the notches 525 on the sliding member 505 as it moves axially by the continued attractive force from the magnetic pattern 565 in the key 560. In other words, the key may remain in place within the bore of the downhole tool to actively hold the tumbler pins in the open position while the sliding member slides with respect to the housing (at least long enough to allow all of the pins to clear all of the notches in the sliding member). Typically, the sliding member is driven (so that it slides) by some force other than the magnetic pattern of the key. In other words, some other means (other than the key) shifts the sliding member once the key unlocks the tumbler pins. In another embodiment, the tumbler pins 520 may be held in place using another method, such as a latch, to keep the tumbler pins from re-entering one of the notches 525. Once the sliding member 505 has moved to a second desired position with the notches at least clearing the pins), the key 560 may be removed from interaction with the tumbler pins 520, as shown in FIG. 5D, and driven to another location in the completion string if desired (for example, to interact with another corresponding downhole tool). In the embodiment of FIG. 5D, once the sliding member 505 is in a second position, the tumbler pins 520 may continue to compress the biasing members 540 and stay completely within holes 535 in the fixed housing 510 if the sliding member 505 does not contain any other notches 525 to receive the tumbler pins 520. In some embodiments, the sliding member might contain another matching set of notches that could engage with the tumbler pins to lock the sliding member in a second fixed position. Any number of such matching notches on the inner surface of the sliding member could be provided, perhaps allowing the key 560 to unlock and lock the downhole tool repeatedly. Thus, FIGS. 5C-5D show sliding of the sliding member while it is in the unlocked position.

Figure 6:
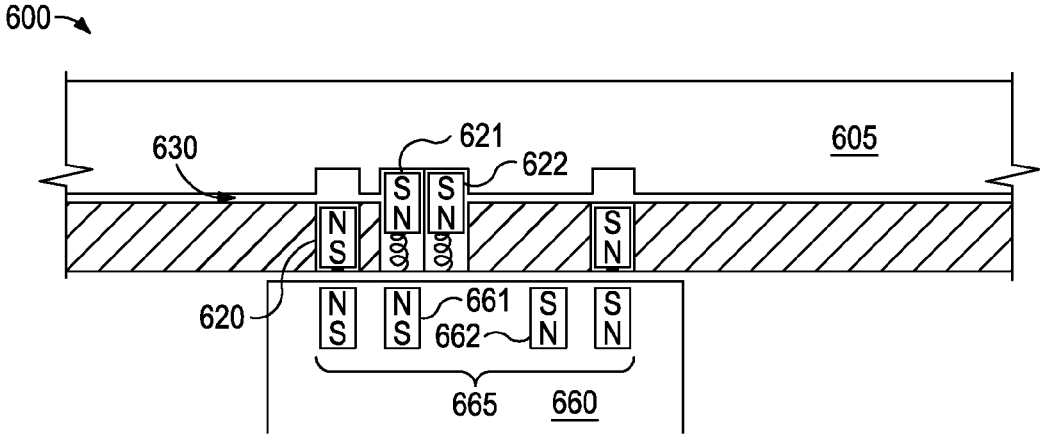
FIG. 6 illustrates an embodiment of interaction between a magnetic pattern key with a downhole tool designed to respond to a different magnetic pattern (such that the key will not unlock the downhole tool)

The embodiment of FIG. 6 is an exemplary diagram of a key 660 that will not unlock sliding member 605 in a downhole tool 600. In order for the sliding member 605 to be free to move, all of the tumbler pins 620 must be in an unlocked position (i.e. not crossing the sliding line 630). In the embodiment of FIG. 6, two tumbler pins 621 and 622 remain in a locked position when the key 660 is in place (because the magnetic pattern of the key does not correspond to the magnetic pattern of the downhole tool tumbler pins). Tumbler pin 621 does not move to an unlocked position because the corresponding magnet 661 in the magnetic pattern 665 of the key 660 is oriented so that the polarity of the magnet 661 repels the tumbler pin 621 instead of attracting the pin. Tumbler pin 622 does not move to an unlocked position because there is not a corresponding magnet in the key 660 to provide an attractive force to work against the biasing member 640. If properly positioned, the magnet 662 might attract the tumbler pin 622 into an unlocked position, but the location of magnet 662 is such that it does not interact with the tumbler pin 622 when the key 660 is in place. In other words, the spacing and orientation of the magnets in the key do not match the spacing and orientation of the pins in the downhole tool, such that the key does not correspond to the downhole tool in FIG. 6 and thus cannot unlock it. Orientation and location of the magnets within the magnet pattern of a key may determine if the key will interact to unlock a sliding member in a downhole tool. Thus, FIG. 6 shows a key that will not unlock a non-corresponding downhole tool.

Figure 7A:
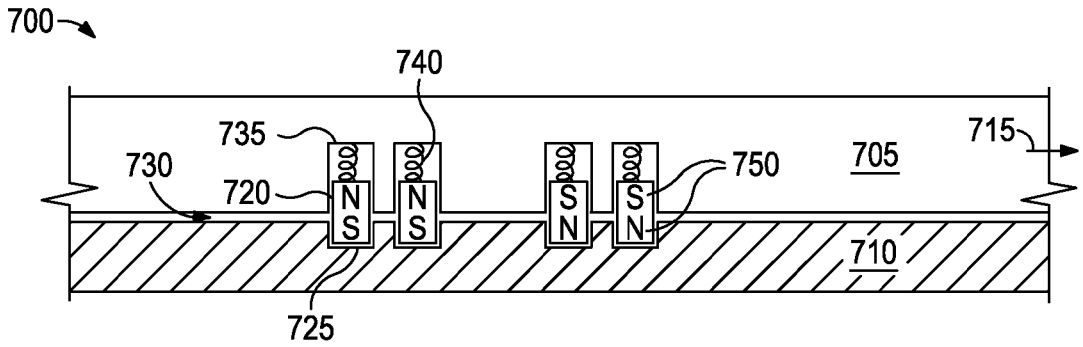
FIGS. 7A-7D illustrate another embodiment of a method for using a key to interface with a downhole tool.

The embodiment of FIGS. 7A-7D shows an exemplary method of locking and/or unlocking a sliding member 705, and the movement of the sliding member 705 with respect to a fixed housing 710. FIG. 7A shows another embodiment of a downhole tool 700 which may comprise a sliding member 705 (which may slide in an axial/longitudinal direction 715) and a fixed housing 710. The sliding member 705 may be held in a locked position by one or more tumbler pins 720 that may provide mechanical interference interaction between the sliding member 705 and the fixed housing 710, when in the locked position. In the embodiment shown in FIG. 7A, an exemplary number of four tumbler pins 720 are used to lock the sliding member 705, but any number of tumbler pins could be used. In an embodiment, the tumbler pins 720 may be spaced longitudinally along the length of the completion string and may be considered in a locked position when at least one pin 720 spans a sliding line 730 between the fixed housing 710 and the sliding member 705. In the embodiment of FIG. 7A, the tumbler pins 720 may be housed within holes 735 in the sliding member 705 of the downhole tool 700 and may interact with notches 725 in the surface of the fixed housing 710 that may receive the tumbler pins 720 in a radial direction. The tumbler pins 720 may be held in place in the notches 725 of the fixed housing 710 with a biasing member 740 (such as a spring) that may serve to bias the tumbler pins 720 towards a locked position. In an embodiment, the tumbler pins 720 may comprise magnetic material that would create magnetic poles 750 (north and south) within the tumbler pins 720. Thus, FIG. 7A shows a downhole tool with the sliding member (and/or its tumbler pins) in a locked position.

Figure 7B:
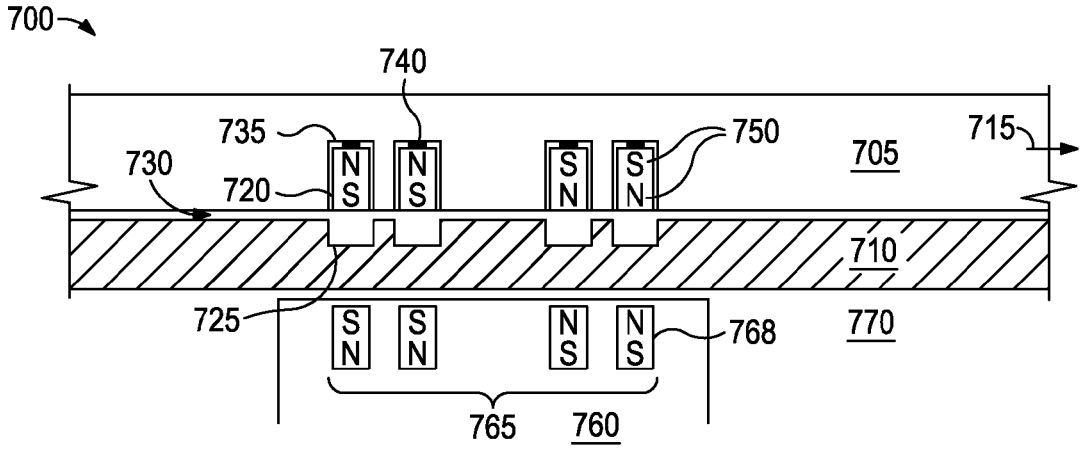

In the embodiment of FIG. 7B, a key 760 may be introduced into the completion string to interact with the downhole tool 700. The key 760 may fit within the bore 770 of the completion string and may be driven downhole to a position within the completion string that may allow for magnetic interaction with one or more downhole tools 700. The key 760 may contain a magnetic pattern 765 comprising one or more magnets 768 that may be located (radially/circumferentially and/or axially/longitudinally) and oriented (with a specific polarity) to magnetically interact with corresponding tumbler pins 720 in the downhole tool 700. Magnetic interaction may comprise repositioning the tumbler pins 720 radially with respect to the sliding line 730 (into locked/unlocked positions, for example). In the embodiment of FIG. 7B, the presence of the magnetic pattern 765 may create a repulsive force between the magnets 768 and the tumbler pins 720 that may cause the tumbler pins 720 to act against the biasing members 740 and withdraw across the sliding line 730 between the sliding member 705 and the fixed housing 710. The magnets 768 in the key 760 may be oriented in such a way that they repulse all of the tumbler pins 720 located within the sliding member 705 and the tumbler pins 720 may move radially away from the key 760 and cross the sliding line 730 into an unlocked position. So FIG. 7B shows the magnetic introduction of a key with a corresponding downhole tool, to move all of the tumbler pins into an unlocked position (so that the sliding member is unlocked/unrestricted and free to slide).

Figure 7C:
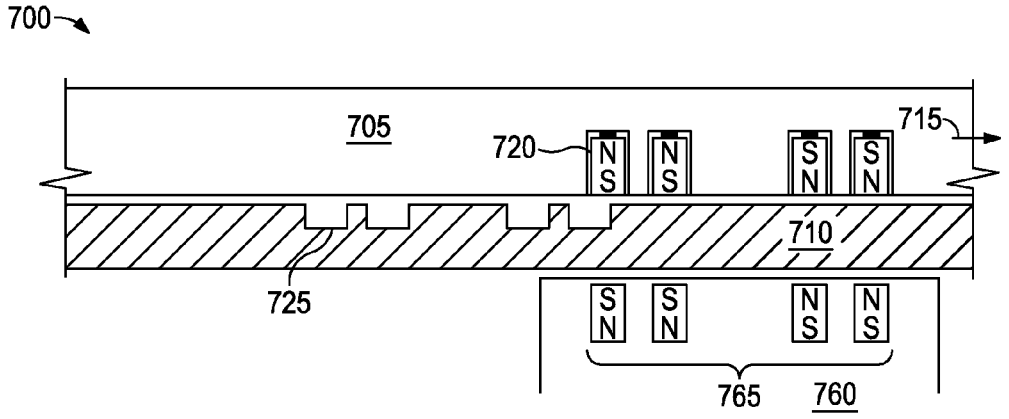
Figure 7D:
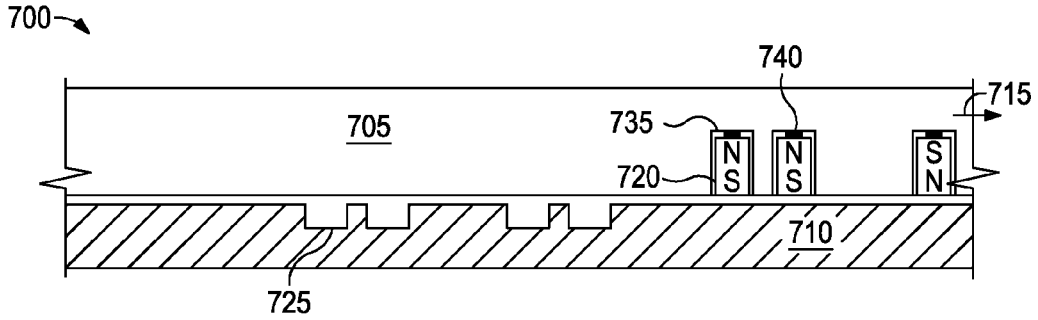

In the embodiment shown in FIG. 7C, the key 760 may remain in interaction with the tumbler pins 720 within the fixed housing 710 at least sufficiently long to allow the pins to all clear all of the notches in the sliding member, so that the sliding member 705 to slide in an axial/longitudinal direction 715. The tumbler pins may be kept from entering one of the notches 725 on the sliding member 705 as it moves axially by the continued repulsive force from the magnetic pattern 765 in the key 760. In another embodiment, the tumbler pins 720 may be held in place using another method, such as a latch, to keep the tumbler pins from re-entering one of the notches 725. Once the sliding member 705 has moved to a second desired position, the key 760 may be removed from the interaction with the tumbler pins 720, as shown in FIG. 7D, and driven to another location in the completion string if desired. In the embodiment of FIG. 7D, once the sliding member 705 is in a second position, the tumbler pins 720 may continue to compress the biasing members 740 and stay within holes 735 in the sliding member 705 if the fixed housing 710 does not contain any other notches 725 to receive the tumbler pins 720. Typically, the sliding member is motivated to slide by some force/means other than the magnetic pattern (typically provided by some other means than the key). So FIGS. 7C-7D show the axial movement of the unlocked sliding member.

In alternative embodiments, the tumbler pins may be spaced around the circumference of the bore 870 in the downhole tool as shown in FIGS. 8A-8F. Although the tumbler pins may be housed within holes 835 located in either the fixed housing 810 or the sliding member 805 (as discussed above with respect to FIGS. 5 and 7), in the exemplary diagram of FIGS. 8A-8F, a combination of both locations for the tumbler pins is used. For example, two tumbler pins 821 and 822 are located within the fixed housing 810 of the downhole tool 800 and two tumbler pins 823 and 824 are located within the sliding member 805. Persons of ordinary skill in the art will understand with the aid of this disclosure that a variety of pin spacing/location/arrangements are possible and included with the scope of this disclosure.

Figure 8B:
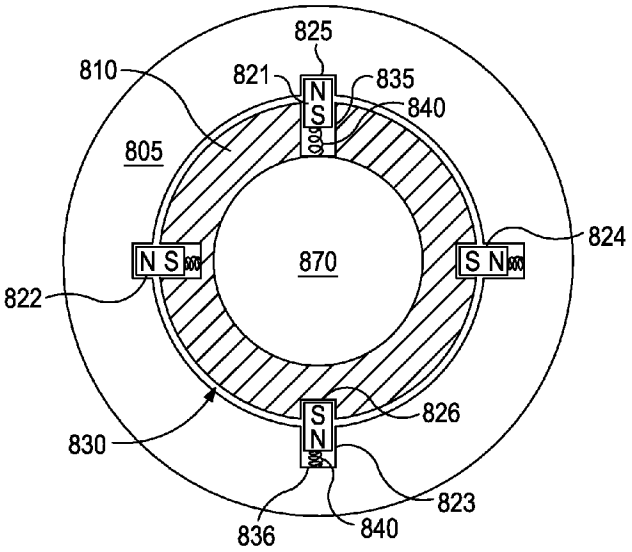
FIGS. 8A-8F illustrate yet another embodiment of a method for using a key to interface with a downhole tool, with FIGS. 8A, 8C, and 8E showing longitudinal cross-sections and FIGS. 8B, 8D, and 8F showing corresponding radial cross-sections to illustrate interaction of a key and a downhole tool using tumbler pins location circumferentially.
Figure 8A:
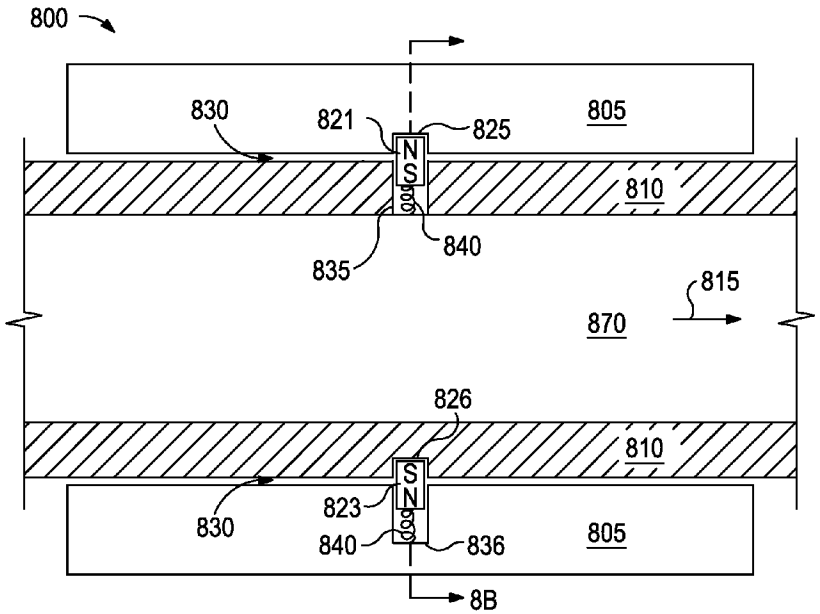

In the embodiment shown in FIG. 8A, a downhole tool 800 may comprise a sliding member 805 (which may slide in an axial/longitudinal direction 815, circumferentially, and/or any combination of motions such as resulting from the use of a j-slot) and a fixed housing 810. The sliding member 805 of a downhole tool 800 may be held in a locked position by one or more tumbler pins 821, 822, 823, and 824 that may provide physical interference interaction between the sliding member 805 and the fixed housing 810 when in the locked position. FIG. 8B provides a related cross-section showing circumferential placement of the pins in the embodiment with an exemplary number of four tumbler pins 821, 822, 823, and 824 holding the sliding member 805 (but any number of tumbler pins could be used). The tumbler pins 821, 822, 823, 824 may be considered in a locked position when at least one pin spans a sliding line 830 between the fixed housing 810 and the sliding member 805. In the embodiment of FIGS. 8A and 8B, the tumbler pins 821, 822 may be housed within holes 835 in the fixed housing 810 of the downhole tool 800, and may mechanically interact with notches 825 in the surface of the sliding member 805 that may receive ends of the tumbler pins 821, 822 in a radial direction. The tumbler pins 821, 822 may be held in place in the notches 825 of the sliding member 805 with biasing members 840 (such as a spring) located within the housing that may serve to bias the tumbler pins 821, 822 towards a locked position (for example, towards the notches). Additionally, the tumbler pins 823, 824 may be housed within holes 836 in the sliding member 805 of the downhole tool 800, and may mechanically interact with notches 826 in the surface of the fixed housing 810 that may receive the tumbler pins 823, 824 in a radial direction. The tumbler pins 823, 824 may be held in place in the notches 826 of the fixed housing 810 with biasing members 840 (such as a spring) located within the sliding member that may serve to bias the ends of tumbler pins 823 and 824 towards a locked position (for example, towards the notches). In an embodiment, the tumbler pins 821, 822, 823, 824 may comprise magnetic material that would create magnetic poles (North and South) within the tumbler pins.

Figure 8D:
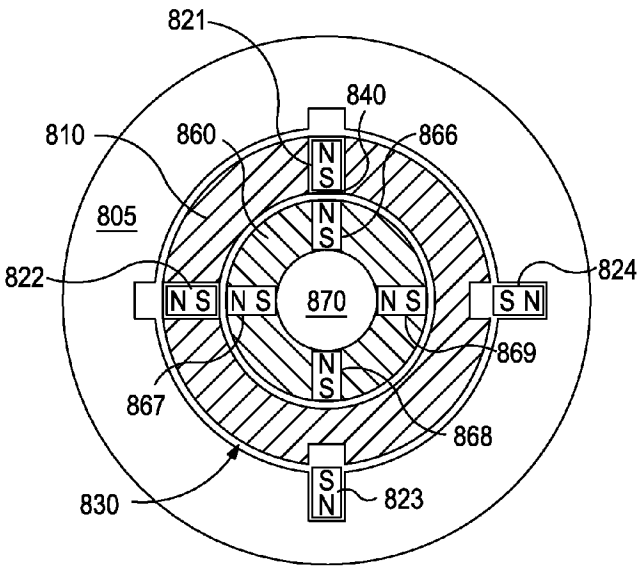
Figure 8C:
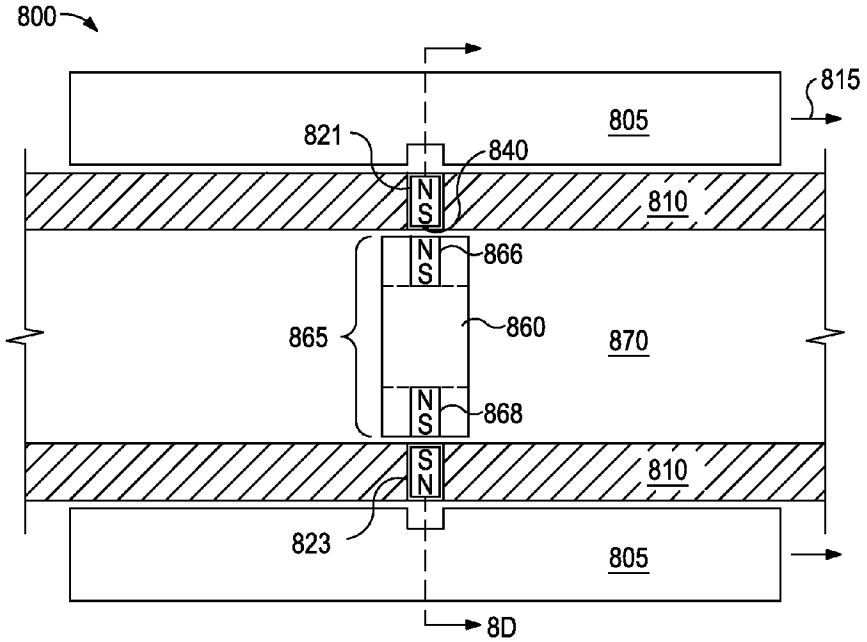

In the embodiment of FIGS. 8C and 8D, a key 860 may be introduced into the completion string to interact with the downhole tool 800. The key 860 may fit within the bore 870 of the completion string and may be driven downhole to a position within one or more downhole tools that may allow for magnetic interaction with the one or more downhole tools 800. The key 860 may contain a magnetic pattern 865 comprising one or more magnets 866, 867, 868 and 869 that may be located (radially/circumferentially and/or axially/longitudinally) and oriented (with a specific polarity) to allow for magnetically interacting with corresponding tumbler pins 821, 822, 823, and 824 in the downhole tool 800. Magnetic interaction may comprise repositioning the tumbler pins 821, 822, 823, 824 radially with respect to the sliding line 830 into locked/unlocked positions. Shown in the embodiment of FIGS. 8C and 8D, the presence of a corresponding magnetic pattern 865 may create an attractive force between the magnets 866, 867, 868, 869 and the tumbler pins 821, 822, 823, 824 that may cause the tumbler pins to act against the biasing members 840 to withdraw across the sliding line 830 between the sliding member 805 and the fixed housing 810. The magnets 866, 867 in the magnetic pattern of the key 860 may be oriented in such a way that they attract the tumbler pins 821, 822 located within the fixed housing 810 and the tumbler pins 821, 822 may move radially toward the key 860 and withdraw across the sliding line 830 into an unlocked position. The magnets 868, 869 in the key 860 may be oriented in such a way that they repulse the tumbler pins 823, 824 located within the sliding member 805 and the tumbler pins 823, 824 may move radially away from the key 860 and withdraw across the sliding line 830 into an unlocked position.

Figure 8F:
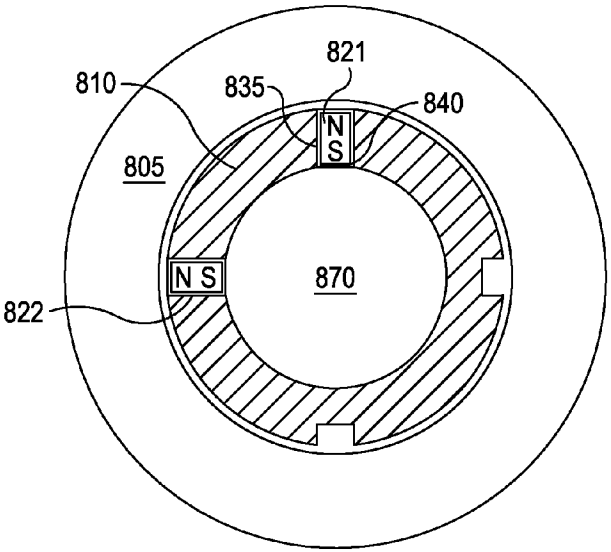
Figure 8E:
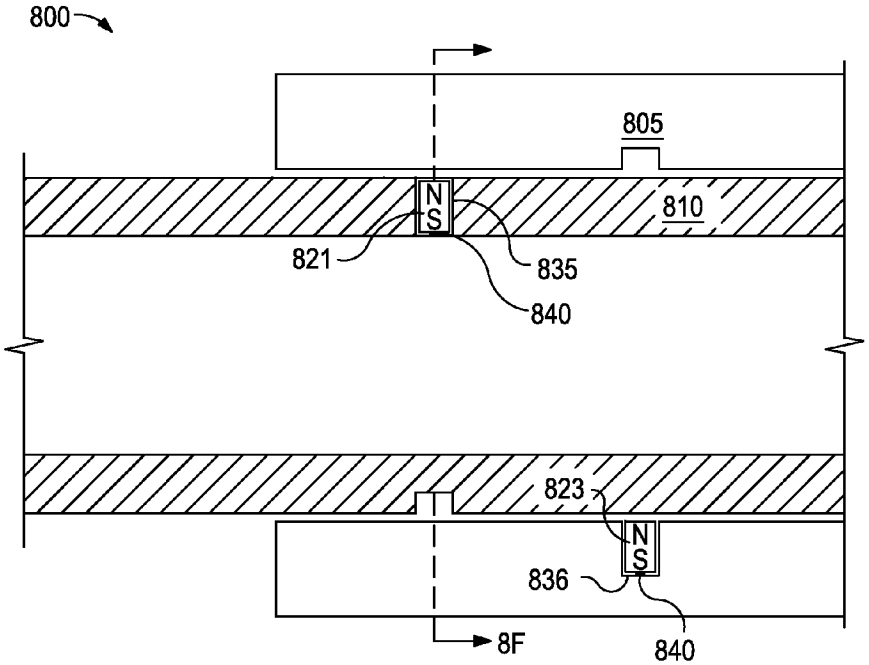

As FIGS. 8E and 8F shows, once unlocked the sliding member 805 may move (slide) to a second desired position, and the key 860 may be removed from the interaction with the tumbler pins 821, 822, 823, 824 and driven to another location in the completion string if desired. In the embodiment of FIGS. 8E and 8F, once the sliding member 805 is in the second position, the tumbler pins 821, 822, 823, 824 may continue to compress the biasing member 840 and stay within holes 835 and 836 in the fixed housing 810 and/or in the sliding member 805, if the sliding member 805 and/or the fixed housing 810 do not contain any other notches to receive the tumbler pins. In other words, the sliding member and/or pins may remain in an unlocked position despite removal of the key so long as there are no other notches to receive the ends of the pins (since the interface between the housing/sliding member and the pins would not allow the pins to span the sliding line).

Figure 9A:
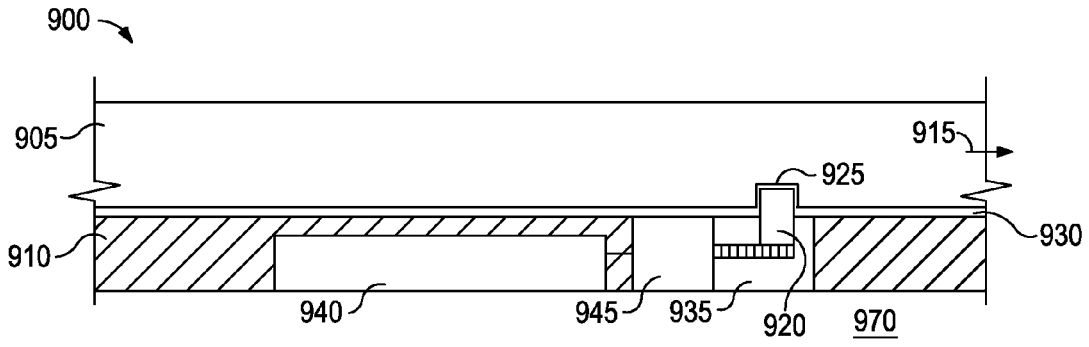
FIGS. 9A-9C illustrate an embodiment of a method for using a key to interface with a downhole tool with electronic controls.
Figure 9B:
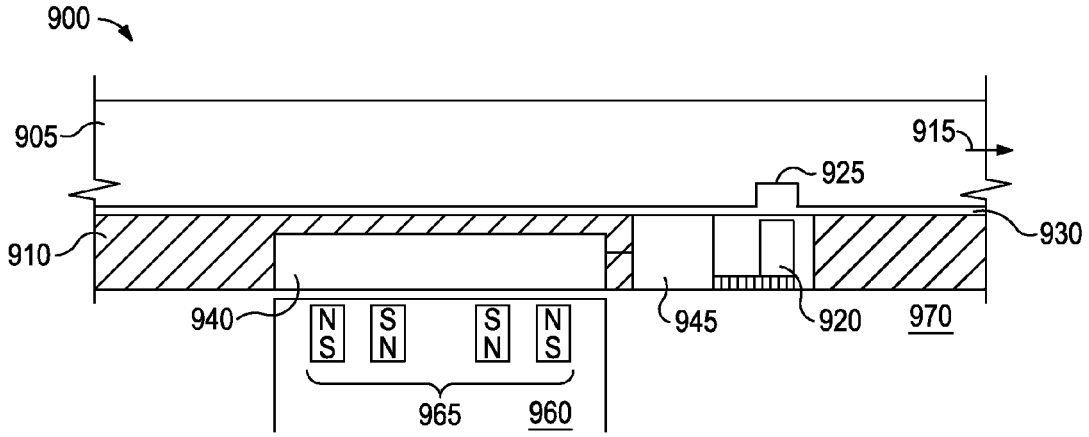
Figure 9C:
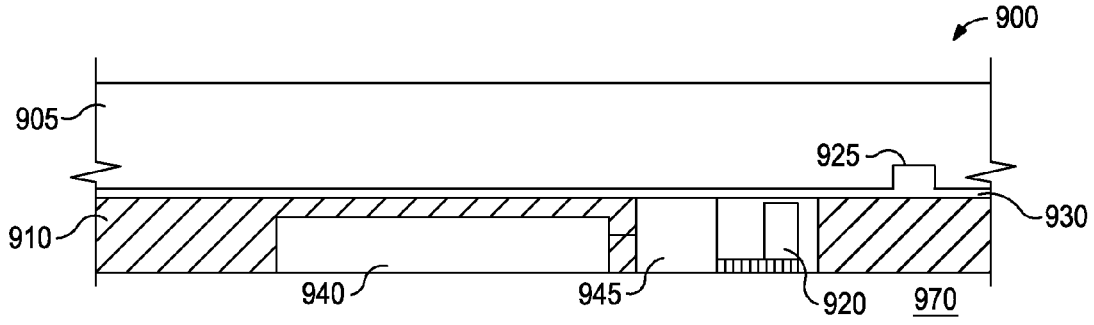

The embodiment of FIGS. 9A-9C shows another exemplary method of locking and/or unlocking a sliding member 905, and the movement of the sliding member 905 with respect to a fixed housing 910. In the embodiment shown in FIG. 9A, a downhole tool 900 may comprise a sliding member 905 (which may slide in an axial/longitudinal direction 915) and a fixed housing 910. The sliding member 905 of a downhole tool 900 may be held in a locked position by an electronic actuator 945. In one embodiment, the electronic actuator 945 may control the movement of one or more pins 920 that may provide mechanical interference interaction between the sliding member 905 and the fixed housing 910. The pin 920 may be held in a locked or unlocked position by the electronic actuator 945, where the pin(s) 920 may be considered in a locked position when (at least one) pin 920 spans a sliding line 930 between the sliding member 905 and the fixed housing 910 and in an unlocked position when the pin 920 does not span the sliding line 930. The electronic actuator 945 may be connected to a magnetic reader 940 that may be operable to detect a magnetic pattern within the bore 970 of the downhole tool 900 and then send a signal to the electronic actuator 945 which may dictate the position of one or more pins 920. In the embodiment of FIG. 9A, the pin(s) 920 may be housed within holes 935 in the fixed housing 910 of the downhole tool 900, and may interact with notches 925 in the inner surface of the sliding member 905 that may receive the pin(s) 920 in a radial direction. In the embodiment of FIG. 9B, the magnetic reader 940 may detect the presence of a magnetic pattern 965 within the bore of the downhole tool (for example due to placement of a magnetic key 960), which may then cause the magnetic reader 940 to send an electronic signal to the electronic actuator 945, causing the electronic actuator 945 to move the pin(s) 920 in a radial direction from one position to another. In the embodiment of FIG. 9B, for example, the pin(s) 920 may then be moved to an unlocked position and the sliding member 905 may be free to move in an axial direction 915. FIG. 9C shows the unlocked sliding member 905 sliding to another position with respect to the fixed housing 910.

Figure 10A:
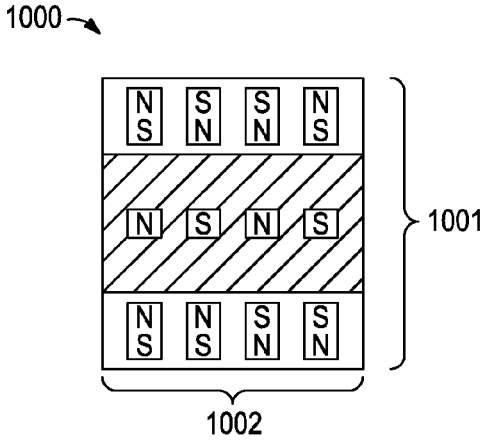
FIGS. 10A and 10B illustrate embodiments of a magnetic key with a plurality of magnetic patterns therein.
Figure 10B:
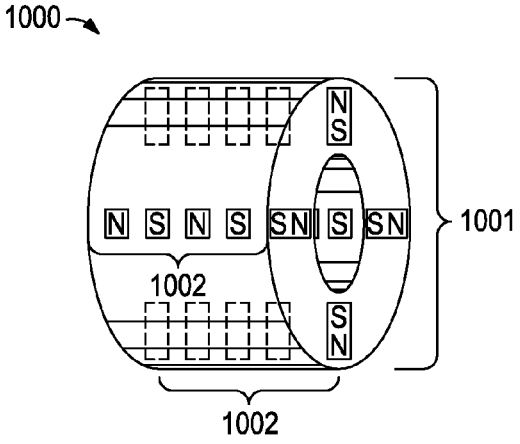

FIGS. 10A-10B show an embodiment of a key 1000 which may contain a plurality of magnetic patterns to allow for interaction with multiple downhole tools which may contain pins with different polarities or spacing (i.e. each downhole tool may respond to a different magnetic pattern, and in some embodiments a single key might have multiple magnetic patterns to allow for interaction with multiple of such downhole tools). For example, radial (circumferential) magnetic pattern 1001 might be used to interact with tumbler pins in a downhole tool located circumferentially around a bore in the downhole tool, such as in FIGS. 9A-9C. In the embodiment shown in FIG. 10A-10B, the key might contain four different radial magnetic patterns 1001 to enable interaction with at least four different downhole tools. Additionally (or alternatively), an axial (longitudinal) magnetic pattern 1002 might be used to interact with tumbler pins located longitudinally along the length of one or more downhole tools, such as in FIGS. 5A-5D. In the embodiment shown in FIG. 10A-10B, the key might contain four different axial magnetic patterns 1002 to enable interaction with at least four different downhole tools (based for example on the orientation of the key in the bore). The exemplary embodiment shown in FIGS. 10A-10B comprises four different magnetic patterns, but a key could be made to contain any number of magnetic patterns to allow interaction with any number of downhole tools. In an embodiment, a key containing multiple magnetic patterns may also comprise a method or device for orienting the key to a desired orientation within the bore of the completion string so as to allow for interaction with a specific downhole tool. In other embodiments, a single key with a plurality of magnets might be operable to alter the magnetic pattern of the key (by for example altering the spacing of the magnets) to allow for magnetic interaction with a plurality of downhole tools having different magnetic patterns.

Figure 11A:
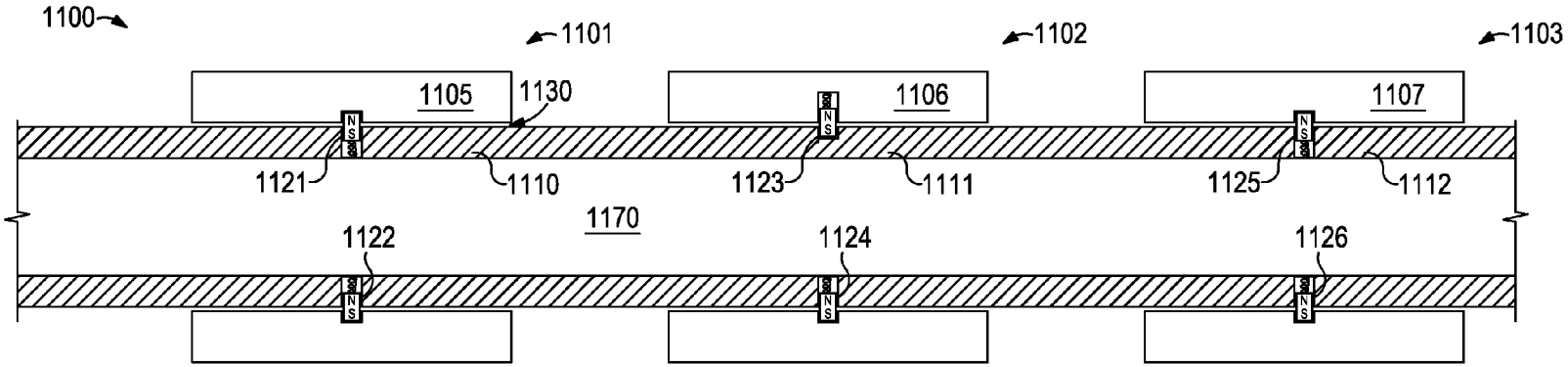
FIGS. 11A-11E illustrate an exemplary method for using a key to interface with multiple downhole tools.

The embodiments of FIGS. 11A-11E show an exemplary method for using a key to interface with multiple downhole tools in a single completion string within a well. In this example, a key with one magnetic pattern might magnetically interact with two or more downhole tools having the same magnetic pattern, while not magnetically interacting with other downhole tools having a different magnetic pattern. In the exemplary tubular string 1100, it may be desired to change the position of the sliding member in downhole tools 1101 and 1103 while not changing the position of the sliding member in downhole tool 1102, for example. Downhole tools 1101, 1102 and 1103 may each comprise a sliding member 1105, 1106, and 1107 (respectively) and a fixed housing 1110, 1111, and 1112 (respectively). Although the fixed housing is shown as a continuous unit in the embodiment of FIG. 11, the fixed housings for separate downhole tools may or may not be continuous (but could most often be separation by tubing). In the embodiment of FIGS. 11A-11E, each sliding member 1105, 1106, and 1107 may be held in place by an exemplary number of two tumbler pins (although any number of tumbler pins might be used), where the tumbler pins 1121, 1122 in downhole tool 1101 may be housed in the fixed housing 1110 and may interact (typically with mechanical interference) with notches in the sliding member 1105; the tumbler pin 1123 in downhole tool 1102 may be housed in the sliding member 1106 and may interact with a notch in the fixed housing 1111; the tumbler pin 1124 in downhole tool 1102 may be housed in the fixed housing 1111 and may interact with a notch in the sliding member 1106; and the tumbler pins 1125, 1126 in downhole tool 1103 may be housed in the fixed housing 1112 and may interact with notches in the sliding member 1107. FIG. 11A illustrates all of the sliding members being in a locked position prior to introduction of a key (with all of the tumbler pins in the three downhole tools 1101, 1102, 1103 in a locked position (i.e. at least one of the tumbler pins for each downhole tool spans the sliding line 1130)).

Figure 11B:
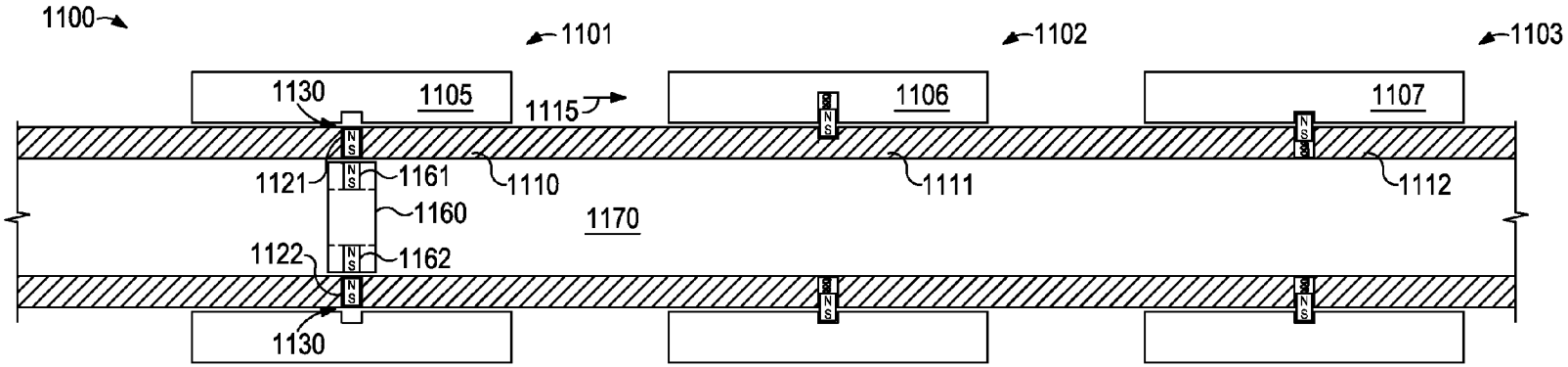
Figure 11C:
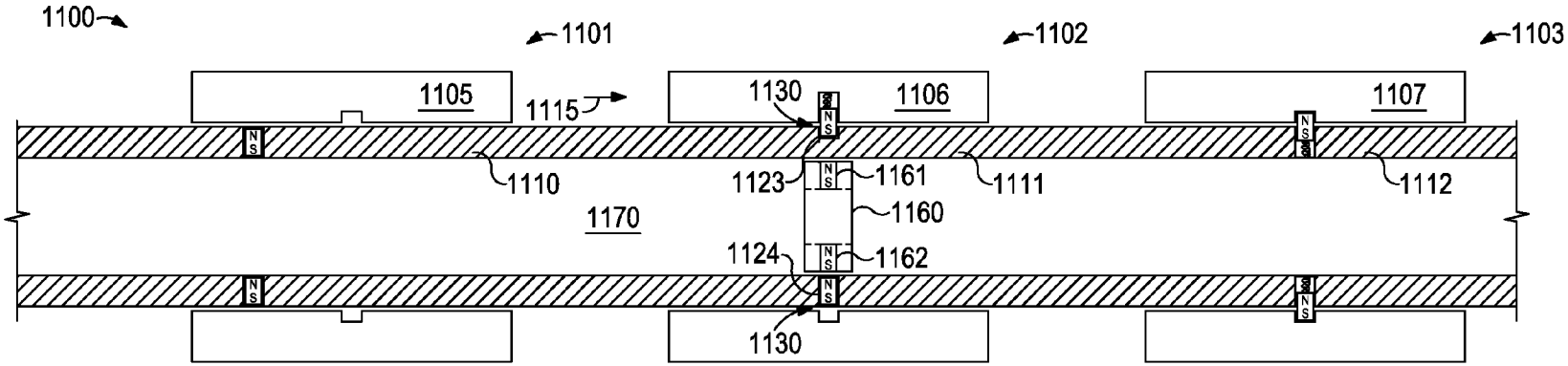

FIG. 11B shows introduction of a key 1160 (that may fit in the bore 1170 of the tubular string 1100) downhole within the completion string to a position (typically within the bore of the downhole tool 1101) in which the key may interact with tumbler pins 1121 and 1122 in downhole tool 1101. The key 1160 in FIG. 11B may comprise magnets 1161 and 1162 that attract tumbler pins 1121 and 1122 (respectively) so that they withdraw across the sliding line 1130 into an unlocked position (entirely within the housing). The sliding member 1105 of downhole tool 1101 would then be free to slide in an axial direction 1115 to another position with respect to the fixed housing 1110 (as shown in FIG. 11C, for example). Typically, movement of the sliding member is not motivated by the magnetic pattern of the key, but by some separate driving force.

FIG. 11C shows movement of the key 1160 (that may fit in the bore 1170 of the tubular string 1100) further downhole so that it may interact with tumbler pins 1123 and 1124 in downhole tool 1102. The magnets 1161, 1162 within the key 1160 may attract tumbler pins 1123 and 1124 (respectively). However, the attractive force causes only tumbler pin 1124 to cross the sliding line 1130 into an unlocked position, while tumbler pin 1123 remains in a locked position (due to its location housed in the sliding member, for example). Therefore, sliding member 1106 would not be free to move in an axial direction 1115 (i.e. it would remain locked despite the presence of the key since the key does not have the correct magnetic pattern for unlocking downhole tool 1102) and would remain in the original position after the key 1160 moves away from the downhole tool 1102.

Figure 11D:
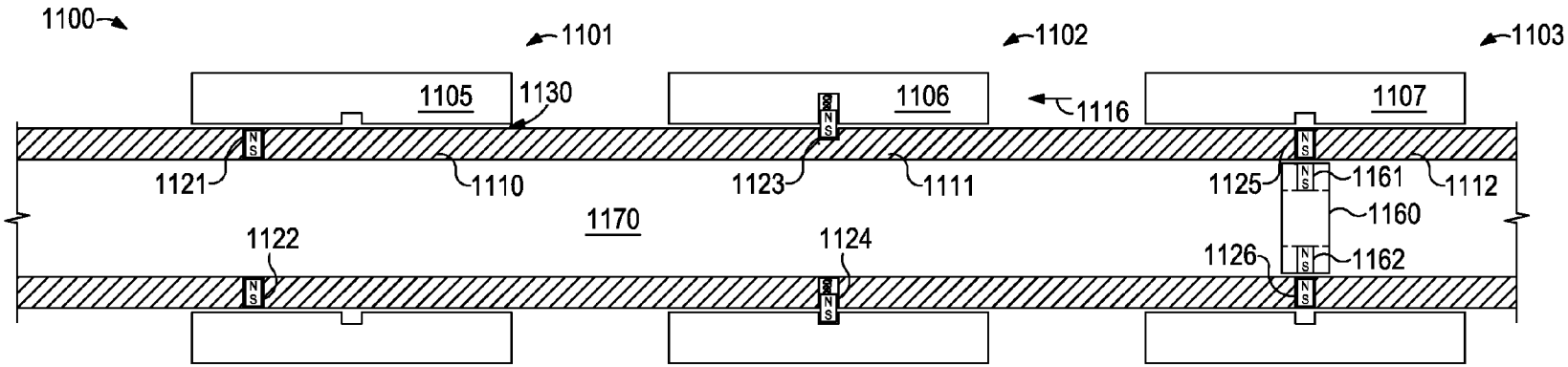

In FIG. 11D the key 1160 (that may fit in the bore 1170 of the tubular string 1100) has moved further downhole so that it may interact with tumbler pins 1125 and 1126 in downhole tool 1103. The location and orientation (forming the magnetic pattern) of the tumbler pins in downhole tool 1107 may be identical to the location and orientation of the tumbler pins in downhole tool 1105. The key 1160 magnets 1161 and 1162 may attract tumbler pins 1125 and 1126 (respectively) so that they withdraw across the sliding line 1130 into an unlocked position. The sliding member 1105 of downhole tool 1101 would then be free to slide in an axial direction 1116 (which may be different than the axial direction 1115 in some embodiments) to another position with respect to the fixed housing 1112. While the sliding members 1105, 1107 may slide in different axial directions 1115 and 1116 in the embodiment of FIG. 11, it should be understood that sliding members may be enabled to slide in either axial direction 1115 and 1116 depending on the desired result of the movement. Alternatively, one or more sliding movements might be non-axial.

Figure 11E:
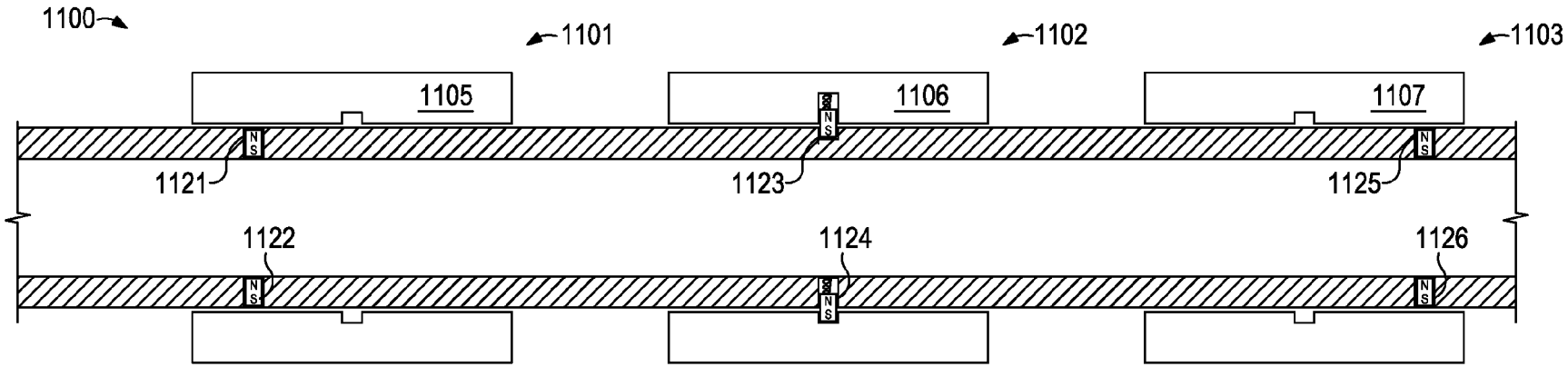

In FIG. 11E, the magnetic key has passed the location of all three downhole tools in the tubular string 1100 after changes have been made to downhole tools 1101 and 1103 using a magnetic key. The sliding members 1105, 1107 may be in different positions with respect to the fixed housings 1110, 1112 and may not be locked by the same tumbler pins 1121, 1122, 1125, 1126 as in FIG. 11A, while sliding member 1106 may remain in the same position and may remain locked by the same tumbler pins 1123, 1124 as in FIG. 11A. As an alternative embodiment, a single key with multiple patterns might interact magnetically with a plurality of downhole tools having different patterns, while not interacting with other downhole tools having still other, different magnetic patterns.

Having discussed the various systems and methods, embodiments may include, but are not limited to:

In an embodiment, a downhole system comprises: a completion string, comprising a downhole tool, and a magnetic key wherein: the downhole tool comprises a housing having a bore therethrough forming part of a fluid flowpath through the completion string and a sliding member operable to slide with respect to the housing and having a locked position and an unlocked position; the key comprises a body operable to fit in the bore of the downhole tool and a plurality of magnets, each having at least one pole directed radially outward from the bore of the downhole tool, and the plurality of magnets may be located and oriented with respect to the body to form a magnetic pattern that may magnetically interact with the downhole tool to unlock the sliding member. In some embodiments, the tool may further comprise a plurality of magnetic pins and a corresponding number of springs, where the locked and unlocked position of the sliding member may be based on the position of the plurality of pins. Further, in some embodiments, a sliding line may be formed by the interfacing surfaces of the sliding member and the housing. In some embodiments, the plurality of pins comprise a locked position and an unlocked position, whereby in the locked position at least one pin spans the sliding line to prevent the sliding member from sliding with respect to the housing, while in the unlocked position no pins span the sliding line (thereby allowing the sliding member to be free to slide with respect to the housing), and the plurality of springs may bias the pins towards the locked position.

In some embodiments, the plurality of pins may be located and magnetically oriented to form a magnetic pattern (where the magnetic pattern of the pins corresponds to a related unlocking magnetic pattern in a corresponding key). In some embodiments, the plurality of pins and the plurality of springs may be located/housed in (corresponding) holes in the (fixed) housing (and are operable to slide in the holes), wherein the sliding member comprises matching holes/notches for receiving ends of the pins in the locking position, and the unlocking magnetic key pattern may magnetically attract all of the plurality of pins with sufficient force to move the pins to an unlocked position. In some embodiments, the plurality of pins and the plurality of springs may be located in (corresponding) holes in the sliding member (and are operable to slide in the holes), wherein the housing comprises matching holes/notches for receiving ends of the pins in the locked position, and the unlocking magnetic key pattern may magnetically repulse all of the plurality of pins with sufficient force to move the pins to an unlocked position. In some embodiments, the location of the plurality of magnetic pins comprises one of the following: longitudinal spacing, circumferential spacing, or a combination of longitudinal and circumferential spacing.

In some embodiments, the downhole tool may further comprise a valve/port (wherein the sliding member may be operable to open/close/alter the flow rate through the valve/port), and in some embodiments, the tool comprises an inflow control device (ICD). In some embodiments, the impetus for sliding motion of the sliding member with respect to the housing may not be provided by the key/magnetism/direct influence of the magnetic pattern, with the magnetic pattern only unlocking the sliding member (to allow sliding with respect to the housing) but not actually directly inducing/causing/motivating the sliding movement. So the driving force for actuating sliding movement of the sliding member may not be provided by the magnetic pattern, but rather may be provided by a separate driving force (which for example could be pressure differential, spring or other mechanical means, electrical motor, hydraulics, etc.).

In an embodiment, an electronic actuator may unlock the sliding member in response to detection of an unlocking magnetic pattern by a magnetic reader. Further, a sliding line may be formed by interfacing surfaces of the sliding member and the housing; unlocking the sliding member may comprise moving one or more radial pins so that none of the one or more pins span the sliding line, and the one or more pins comprise a locked position and an unlocked position, whereby in the locked position at least one pin spans the sliding line to prevent the sliding member from sliding with respect to the housing, while in the unlocked position no pins span the sliding line (thereby allowing the sliding member to be free to slide with respect to the housing). In some embodiments, unlocking the sliding member comprises applying force to the sliding member to induce sliding with respect to the housing.

Additional aspects of the disclosure may include embodiments of a downhole tool for use in a completion string, comprising one or more of the following: a (fixed) housing having a bore therethrough forming part of a fluid flowpath through the completion string; a sliding member operable to slide with respect to the housing; a plurality of magnetic pins; and a corresponding plurality of springs. In some embodiments, a sliding line may be formed by the interfacing surfaces of the sliding member and the housing, and the plurality of pins comprise a locked position and an unlocked position, whereby in the locked position at least one pin spans the sliding line to prevent the sliding member from sliding with respect to the housing, while in the unlocked position no pins span the sliding line (thereby allowing the sliding member to be free to slide with respect to the housing), and the plurality of springs bias the pins towards the locked position. In some embodiments, the sliding member may be operable to slide longitudinally with respect to the housing, while in other embodiments the sliding member may be operable to slide rotationally/circumferentially with respect to the housing.

In some embodiments, the plurality of pins are located and magnetically oriented to form a magnetic pattern (wherein the magnetic pattern of the pins corresponds to a related unlocking magnetic pattern for a corresponding key), wherein the pins are operable to move to the unlocked position in response to (introduction of) an unlocking magnetic pattern in the bore of the downhole tool. In some embodiments, the plurality of pins and the plurality of springs may be located/housed in (corresponding) holes in the housing (and may be operable to slide in the holes), the sliding member comprises matching holes/notches for receiving ends of the pins in the locking position, and the unlocking magnetic key pattern magnetically attracts all of the plurality of pins with sufficient force to move the pins to the unlocked position. In other embodiments, the plurality of pins and the plurality of springs may be located in (corresponding) holes in the sliding member (and may be operable to slide in the holes), the housing comprises matching holes/notches for receiving ends of the pins in the locked position, and the unlocking magnetic key pattern magnetically repulses all of the plurality of pins with sufficient force to move the pins to the unlocked position. In some embodiments, the location of the plurality of magnetic pins comprises one of the following: longitudinal spacing, circumferential spacing, or a combination of longitudinal and circumferential spacing.

Some embodiments of a downhole tool may further comprise a valve/port (and wherein the sliding member may be operable to open/close/alter the flow rate through the valve/port), and in some embodiments, the tool comprises an ICD. In some embodiments, the impetus or motivation for sliding motion of the sliding member with respect to the housing may not be provided by the key/magnetism/direct influence of the magnetic pattern, wherein the magnetic pattern only unlocks the sliding member (to allow sliding with respect to the housing), but does not actually directly induce/cause the sliding movement. In some embodiments, the driving force for actuating sliding movement of the sliding member may not be provided by the magnetic pattern, but rather may be provided by a separate sliding driving force (could be pressure differential, spring or other mechanical means, electrical motor, hydraulics, etc.) So, some embodiments may include a driving force (for moving the sliding member with respect to the housing (i.e. reposition a multi-position downhole tool)), separate from the magnetic pattern (and where the driving force may be non-magnetic), wherein introduction of the unlocking pattern in the bore of the downhole tool (by for example, positioning a magnetic key in the bore) does not directly induce (provide impetus for) sliding movement of the sliding member.

Other aspects of the disclosure may include embodiments of a downhole tool for use in a completion string, comprising: a (fixed) housing having a bore therethrough forming part of a fluid flowpath through the completion string; a sliding member operable to slide with respect to the housing; a magnetic reader operable to detect magnetic patterns in the bore of the downhole tool; and an (electronic) actuator; wherein: the sliding member comprises a locked position and an unlocked position, and the (electronic) actuator may be operable to move the sliding member from a locked (or closed) position to an unlocked (or open) position. In some embodiments, the electronic actuator unlocks the sliding member in response to detection of an unlocking magnetic pattern by the magnetic reader. In some embodiments, a sliding line may be formed by interfacing surfaces of the sliding member and the housing, and unlocking the sliding member comprises moving one or more radial pins so that none of the one or more pins span the sliding line. In some embodiments, the one or more pins comprise a locked position and an unlocked position, whereby in the locked position at least one pin spans the sliding line to prevent the sliding member from sliding with respect to the housing, while in the unlocked position no pins span the sliding line (thereby allowing the sliding member to be free to slide with respect to the housing). Further, unlocking the sliding member comprises applying force to the sliding member to induce sliding with respect to the housing. In some embodiments, the force might be applied by the actuator, while in other embodiments the actuator might simply move one or more pins, with the force to move the sliding member being applied by some separate force means.

Other aspects of the disclosure may include embodiments of a key for use in a downhole completion string having at least one downhole tool, comprising: a body operable to fit in a bore of the completion string; and a plurality of magnets, each having at least one pole directed radially outward (from the bore of the completion string); wherein the plurality of magnets may be located and oriented with respect to the body to form a magnetic pattern (that may magnetically interact with the downhole tool, to unlock the downhole tool for example). In some embodiments, the body comprises a seal (located circumferentially about the body) operable to seal the bore of the completion string when the body is in place in the completion string (so that fluid pressure in the bore may provide longitudinal movement of the key in the completion string), and the seal may optionally be operable to shear upon application of a shearing force (thereby allowing fluid flow around the body even when the key is in place in the bore of the completion string). Some embodiments further comprise an activator located on the nose of the body operable to configure the plurality of magnets into a second magnetic pattern (operable to magnetically interact with the downhole tool to unlock the downhole tool). In some embodiments, the first magnetic pattern of the key might interact magnetically with one or more downhole tool, while the second magnetic pattern might interact magnetically with different downhole tool(s).

In some embodiments, the plurality of magnets may be located in the body to align with corresponding magnetic pins within the downhole tool when the key is located in longitudinal proximity to the downhole tool, and wherein the plurality of magnets may be magnetically oriented (with their poles) to magnetically interact with corresponding pins (to radially move all of the pins within the downhole tool so that no such pins span a sliding line within the downhole tool, i.e. to unlock the downhole tool). In some embodiments, magnetic interaction may comprise one of the following: magnetic attraction, magnetic repulsion, or a combination of attraction and repulsion, and the location of the plurality of magnets may comprise one of the following: longitudinal spacing, circumferential spacing, or a combination of longitudinal and circumferential spacing.

Other aspects of the disclosure may include embodiments of a method of unlocking (or locking) one or more downhole tools, each with a bore therethrough forming part of a fluid flowpath through a completion string, comprising: positioning a magnetic key (with an unlocking magnetic pattern for example) within the bore of the downhole tool (with a related magnetic unlocking pattern for example), and magnetically interacting with the downhole tool using the key to unlock (or lock) the downhole tool. In some embodiments, the downhole tool may comprise a sliding member, wherein unlocking the downhole tool may comprise unlocking the sliding member to allow the sliding member to slide, and wherein the magnetic key may only unlock the sliding member (but not provide the actuating force to slide the sliding member). Some embodiments further comprise sliding the sliding member (i.e. providing a separate force to move the sliding member and/or reposition the multi-position downhole tool). In some embodiments, the downhole tool may further comprise a plurality of magnetic pins and a corresponding plurality of springs; wherein a sliding line may be formed by the interfacing surfaces of the sliding member and the housing, and the plurality of pins comprise a locked position and an unlocked position, whereby in the locked position at least one pin spans the sliding line to prevent the sliding member from sliding with respect to the housing, while in the unlocked position no pins span the sliding line (thereby allowing the sliding member to be free to slide with respect to the housing), and wherein the plurality of springs bias the pins towards the locked position. In some embodiments, the plurality of pins may be located and magnetically oriented to form a magnetic pattern (and the magnetic pattern of the pins may correspond to a related (unlocking) magnetic pattern for a corresponding key).

Some embodiments may comprise unlocking the sliding member by moving the pins using an attractive force from the magnetic key to cause the pins to move radially past the sliding line (i.e. so no pins span the sliding line), wherein the pins may be housed within the (fixed) housing and the sliding member comprises matching holes/notches for receiving ends of the pins in the locked position. Other embodiments may comprise unlocking the sliding member by moving the pins using a repulsive force from the magnetic key to cause the pins to cross the sliding line, wherein the pins may be housed within the sliding member and the (fixed) housing comprises matching holes/notches for receiving ends of the pins in the locked position. In some embodiments, a combination of attractive and repulsive forces from the magnetic key may be used to cause the pins to move with respect to the sliding line into an unlocked (or locked) position, wherein a plurality of pins may be housed in both the (fixed) housing and the sliding member and both the housing and the sliding member may comprise matching holes/notches for receiving ends of the pins in the locked position.

In another embodiment, unlocking or locking the sliding member may comprise a magnetic reader scanning the magnetic position of a key, and causing an actuator to alter the position of the sliding member (either between unlock and locked position or between closed and open positions). In another embodiment, unlocking the sliding member may comprise a magnetic reader scanning the magnetic pattern in a key, causing an (electronic) actuator to unlock the sliding member, wherein the (electronic) actuator may unlock the sliding member by moving one or more pins. In some embodiments, the magnetic reader, electronic actuator and pin(s) may be housed in the (fixed) housing and the pin(s) may interact with one or more holes/notches in the sliding member for receiving ends of the pins in the locked position.

Some embodiments may further comprise unlocking a plurality of downhole tools in a completion string using a single magnetic key (wherein the magnetic key comprises a corresponding unlocking magnetic pattern for such downhole tools), and may further comprise leaving one or more of the plurality of downhole tools in the completion string locked despite passing the magnetic key through the bore of those downhole tools. In some embodiments, at least one of the plurality of downhole tools may remain locked despite passing the magnetic key through such downhole tools when the key's magnetic pattern/profile does not match that downhole tool's magnetic unlocking pattern. In other words, the key might magnetically interact with a plurality of downhole tools in a completion string (based on corresponding magnetic pattern(s)), but the key might not magnetically interact with some other downhole tools having different magnetic pattern(s).

Some embodiments further comprise driving the key past all of the downhole tools in the completion string and activating the magnetic (unlocking) pattern of the key (or a second magnetic pattern), wherein the key may comprise an actuator on its front/nose, and wherein activating the magnetic key may comprise driving the key to the bottom of the completion string with sufficient force to activate the actuator. In some embodiments, activating the actuator causes spacing and/or orientation of a plurality of magnets in the key to change to a configuration matching the (unlocking) magnetic pattern of a downhole tool. Some embodiments further comprise using fluid pressure, an electrical, and/or a mechanical force to move the key upward (toward the well head) through the completion string, and recovering the key. In some embodiments, one or more downhole tools may be only magnetically unlocked as the key moves upward.

In some other embodiments, the key may further comprise a seal operable to be sheared off, and the method might further comprise shearing the seal off of the key in proximity to the bottom of the completion string, and parking the key in proximity to the bottom of the completion string. Some other embodiments might further comprise detecting the magnetic pattern as the key passes one of the downhole tools with a magnetic reader responsive to an (unlocking) pattern for the particular downhole tool, which may then activate an electronic actuator to unlock (or lock) the sliding member. Some embodiments further comprise holding the key in position relative to the downhole tool for sufficient duration to allow all of the magnetic pins to clear locking position as the sliding member slides.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A key for use in a downhole wellbore tubular string having at least one downhole tool, comprising:

a body operable to fit in a bore of the wellbore tubular string;

a plurality of magnets, each having at least one pole directed radially outward;

wherein the plurality of magnets are located and oriented with respect to the body to form a magnetic pattern;

wherein the plurality of magnets in a first magnetic pattern are operable to move a plurality of magnetic pins within a first downhole tool into an unlocked pattern, and wherein the plurality of magnets in a second magnetic pattern are operable to move a plurality of magnetic pins within a second downhole tool into an unlocked pattern, and wherein the first magnetic pattern is different from the second magnetic pattern.

2. The key of claim 1, wherein the body comprises a seal operable to seal the bore of the wellbore tubular string when the body is in place in the wellbore tubular string.

3. The key of claim 2, wherein the seal is configured to provide a pressure differential across the body and allow fluid pressure to provide longitudinal movement of the key in the wellbore tubular string.

4. The key of claim 2, wherein the seal is operable to shear upon application of a shearing force.

5. The key of claim 4, wherein the seal is configured to allow fluid flow around the body when the seal is sheared.

6. The key of claim 1, further comprising an activator located on the nose of the body operable to configure the plurality of magnets into a second magnetic pattern.

7. The key of claim 6, wherein the activator is configured to actuate in response to engaging a feature within the bore.

8. The key of claim 6, wherein the second magnetic pattern comprises a different longitudinal spacing of the plurality of magnets as compared to a longitudinal spacing of the plurality of magnets in the magnetic pattern.

9. The key of claim 6, wherein the second magnetic pattern comprises a different circumferential pattern of the plurality of magnets as compared to a circumferential pattern of the plurality of magnets in the magnetic pattern.

10. The key of claim 1, wherein the plurality of magnets are located on the body to align with corresponding magnetic pins within the downhole tool when the key is located in longitudinal proximity to the downhole tool, and wherein the plurality of magnets are magnetically oriented to magnetically interact with corresponding pins.

11. The key of claim 10, wherein magnetic interaction comprises one of the following: magnetic attraction, magnetic repulsion, or a combination of magnetic attraction and magnetic repulsion.

12. The key of claim 1, wherein the location of the plurality of magnets comprises one of the following: longitudinal spacing, circumferential spacing, or a combination of longitudinal and circumferential spacing.

13. The key of claim 1, wherein the body comprises a dart.

14. The key of claim 1, wherein the plurality of magnets are disposed longitudinally within the body.

15. The key of claim 1, wherein the plurality of magnets are disposed circumferentially within the body.

16. The key of claim 1, wherein the body is formed from a non-ferromagnetic material.

17. The key of claim 1, wherein the body comprises one or more of: copper, aluminum, a composite material, titanium, poly-ether-ether ketone (PEEK), polytetrafluoroethylene, a carbon-carbon composite, a phenolic compound, fiber glass, or any combination thereof.

18. The key of claim 1, further comprising a downhole tractor, wherein the body is coupled to the downhole tractor, and wherein the downhole tractor is configured to convey the body into the bore.

19. The key of claim 1, wherein the plurality of magnets are configured to be read by an electronic reader within the downhole tool when the key is located in longitudinal proximity to the downhole tool, and wherein the electronic reader is configured to selectively perform an action based on reading the magnetic pattern of the plurality of magnets.

* * * * *